US006684828B2

(12) United States Patent
Ushijima et al.

(10) Patent No.: US 6,684,828 B2
(45) Date of Patent: Feb. 3, 2004

(54) VARIABLE COMPRESSION RATIO MECHANISM FOR RECIPROCATING INTERNAL COMBUSTION ENGINE

(75) Inventors: Kenshi Ushijima, Kanagawa (JP); Shunichi Aoyama, Kanagawa (JP); Katsuya Moteki, Tokyo (JP); Ryosuke Hiyoshi, Kanagawa (JP); Yoshiaki Tanaka, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 117 days.

(21) Appl. No.: 10/115,893

(22) Filed: Apr. 5, 2002

(65) Prior Publication Data

US 2002/0144665 A1 Oct. 10, 2002

(30) Foreign Application Priority Data

Apr. 5, 2001 (JP) ..... 2001-106649
Mar. 4, 2002 (JP) ..... 2002-057133

(51) Int. Cl.[7] ..... F02B 75/04
(52) U.S. Cl. ..... 123/48 B; 123/78 F; 123/197.3
(58) Field of Search ..... 123/48 B, 317, 123/78 E, 78 F, 197.3, 197.4, 198 R, 48 R

(56) References Cited

U.S. PATENT DOCUMENTS 2,390,558 A 12/1945 Schoen
6,289,857 B1 * 9/2001 Boggs ..... 123/78 E
6,390,035 B2 * 5/2002 Moteki et al. ..... 123/78 BA
6,546,900 B2 * 4/2003 Arai et al. ..... 123/48 B

FOREIGN PATENT DOCUMENTS

JP 2000-73804 3/2000

OTHER PUBLICATIONS

H.N. Pouliot, "Designing a Variable Stroke Engine", Automotive Engineering International, SAE International, US, vol. 85, No. 6, Jun. 1, 1977, pp. 50–55.

* cited by examiner

*Primary Examiner*—Tony M. Argenbright
*Assistant Examiner*—Katrina B. Harris
(74) *Attorney, Agent, or Firm*—Foley & Lardner

(57) ABSTRACT

In a variable compression ratio mechanism for an internal combustion engine employing an upper link, a lower link, and a control link, the lower link includes a crankpin bearing portion into which a crankpin is fitted, a first connecting-pin bearing portion into which a first connecting pin for the upper link is fitted, and a second connecting-pin bearing portion into which a second connecting pin for the control link is fitted. A central connecting portion is provided to connect an axial central portion of at least one of the first and second connecting-pin bearing portions to an axial central portion of the crankpin bearing portion. The central connecting portion has an axial length L1 shorter than each of an axial length L2 of the crankpin bearing portion, an axial length L3 of the first connecting-pin bearing portion, and an axial length L4 of the second connecting-pin bearing portion.

20 Claims, 25 Drawing Sheets

13
23
38
37
22
21

42
25
43
38
30
31
37
35
21
36
22
24
41

23
21
22
38

22
21
23

Fp
Fc
Fu
F1
F2
13
21
22
24
25
31
32
33
34
35
36
37
38
41
42

VARIABLE COMPRESSION RATIO MECHANISM FOR RECIPROCATING INTERNAL COMBUSTION ENGINE

TECHNICAL FIELD

The present invention relates to a variable compression ratio mechanism for a reciprocating internal combustion engine, and particularly to the improvements of a lower link of a multi-link type reciprocating internal combustion engine, rotatably installed on a crankpin.

BACKGROUND ART

In recent years, there have been proposed and developed various variable compression ratio mechanisms for reciprocating internal combustion engines, in which a compression ratio is variable depending upon engine operating conditions, such as engine speed and load. One such variable compression ratio mechanism has been disclosed in Japanese Patent Provisional Publication No. 2000-73804 (hereinafter is referred to as "JP2000-73804"). JP2000-73804 discloses a multi-link type variable compression ratio mechanism that a piston and a crankshaft are mechanically linked to each other via a plurality of links. Briefly explaining, the multi-linked variable compression ratio mechanism of JP2000-73804 includes an upper link, a lower link, and a control link. One end of the upper link is rotatably connected to a piston via a piston pin. The other end of the upper link is rotatably pin-connected to the lower link by means of a first connecting pin. The lower link is rotatably installed onto a crankpin of an engine crankshaft. One end of the control link is rotatably connected to the lower link by means of a second connecting pin. The other end of the control link is rotatably connected onto an eccentric cam of a control shaft. The position of the axis of the eccentric cam relative to the axis of the control shaft, that is, the center (pivot axis) of oscillating motion of the control link shifts or displaces relative to the engine body (a cylinder block) by rotating the control shaft by means of an actuator such as an electric motor. As a result of this, a condition of restriction of motion of the lower link via the control link changes, and thus a crank angle versus piston stroke characteristic (containing the position of TDC), that is, a compression ratio varies. Generally, the lower link has a two-split structure composed of a main lower-link portion and a lower-link bearing cap portion separable from each other, so that the lower link can be installed onto or removed from the crankpin. The main lower-link portion and the lower-link bearing cap portion are integrally connected by means of bolts. The substantially half-round section of the main lower-link portion and the substantially half-round section of the lower-link bearing cap provide or form a cylindrical crankpin bearing, when these two halves are assembled to each other with bolts. The main lower-link portion is also formed with a first connecting-pin bearing portion into which the first connecting pin is inserted and a second connecting-pin bearing portion into which the second connecting pin is inserted. As viewed in a direction perpendicular to the axial direction of the crankpin, each of the first and second connecting-pin bearing portions is formed as a forked end, so that each connecting pin is supported at its both axial ends by means of the forked end composed of a pair of axially-spaced connecting-pin supports or a pair of axially-spaced connecting-pin bearings.

SUMMARY OF THE INVENTION

In the multi-linked variable compression ratio mechanism of JP2000-73804, input load is transferred from the upper link and/or the control link and then acts on the lower link via the first connecting pin and/or the second connecting pin. At this time, the input load is further transferred from the two axially-spaced connecting-pin bearings of the forked end of each connecting-pin bearing portion, and acts directly on axial ends of the cylindrical crankpin bearing (see FIG. 9A). There is a possibility that two axial ends of the cylindrical crankpin bearing are remarkably deformed due to the input load. The crankpin bearing is a slide bearing that supports the load by virtue of the films of lubricating oil. In such slide bearings, there is a tendency that the pressure of the lubricating oil film in the crankpin bearing is relatively high at the axial central portion of the crankpin bearing. On the other hand, the pressure of the lubricating oil film in the crankpin bearing is released at the axial end of the crankpin bearing and thus the pressure of the lubricating oil film is relatively low at the axial end. For the reasons discussed above, if the two axial ends of the cylindrical crankpin bearing deform owing to the input load, the input load may not be satisfactorily supported by virtue of the pressure of the oil film. Therefore, there is a possibility of metal-to-metal contact between the axial ends of the crankpin bearing and the outer peripheral wall surface of the crankpin (the bearing journal portion). This results in extremely rapid wear and increased friction.

Accordingly, it is an object of the invention to provide a variable compression ratio mechanism for a reciprocating internal combustion engine, which avoids the aforementioned disadvantages.

It is another object of the invention to provide a variable compression ratio mechanism for a multi-link type reciprocating internal combustion engine employing an upper link, a lower link, and a control link, which is capable of effectively reducing deformation of axial ends of a crankpin bearing, which may occur owing to input load transferred from a lower-link connecting pin to a connecting-pin bearing portion of the lower link, suppressing the input load from concentratedly acting on the axial ends of the crankpin bearing.

In order to accomplish the aforementioned and other objects of the present invention, a variable compression ratio mechanism for a reciprocating internal combustion engine employing a reciprocating piston movable through a stroke in the engine and having a piston pin, and a crankshaft changing reciprocating motion of the piston into rotating motion and having a crankpin, comprises an upper link connected at its one end to the piston pin, a lower link connected to the other end of the upper link via a first connecting pin and rotatably installed on the crankpin, a control link connected at its one end to the lower link via a second connecting pin, and pivotably connected at the other end to a body of the engine to permit oscillating motion of the control link on the body of the engine, a control mechanism shifting a center of oscillating motion of the control link to vary a compression ratio of the engine, and the lower link comprising a crankpin bearing portion into which the crankpinis fitted, a first connecting-pin bearing portion, which is parallel to the crankpin bearing portion and into which the first connecting pin is fitted, a second connecting-pin bearing portion, which is parallel to the crankpin bearing portion and into which the second connecting pin is fitted, a central connecting portion having an axial length shorter than each of an axial length of the crankpin bearing portion, an axial length of the first connecting-pin bearing portion, and an axial length of the second connecting-pin bearing portion, and the central connecting portion that connects an axial central portion of at least one of the first and second connecting-pin bearing portions to an axial central portion of the crankpin bearing portion.

The other objects and features of this invention will become understood from the following description with reference to the accompanying drawings.

DESCRIPTION OF THE PREFERRED EMBODIMENTS

Figure 1:
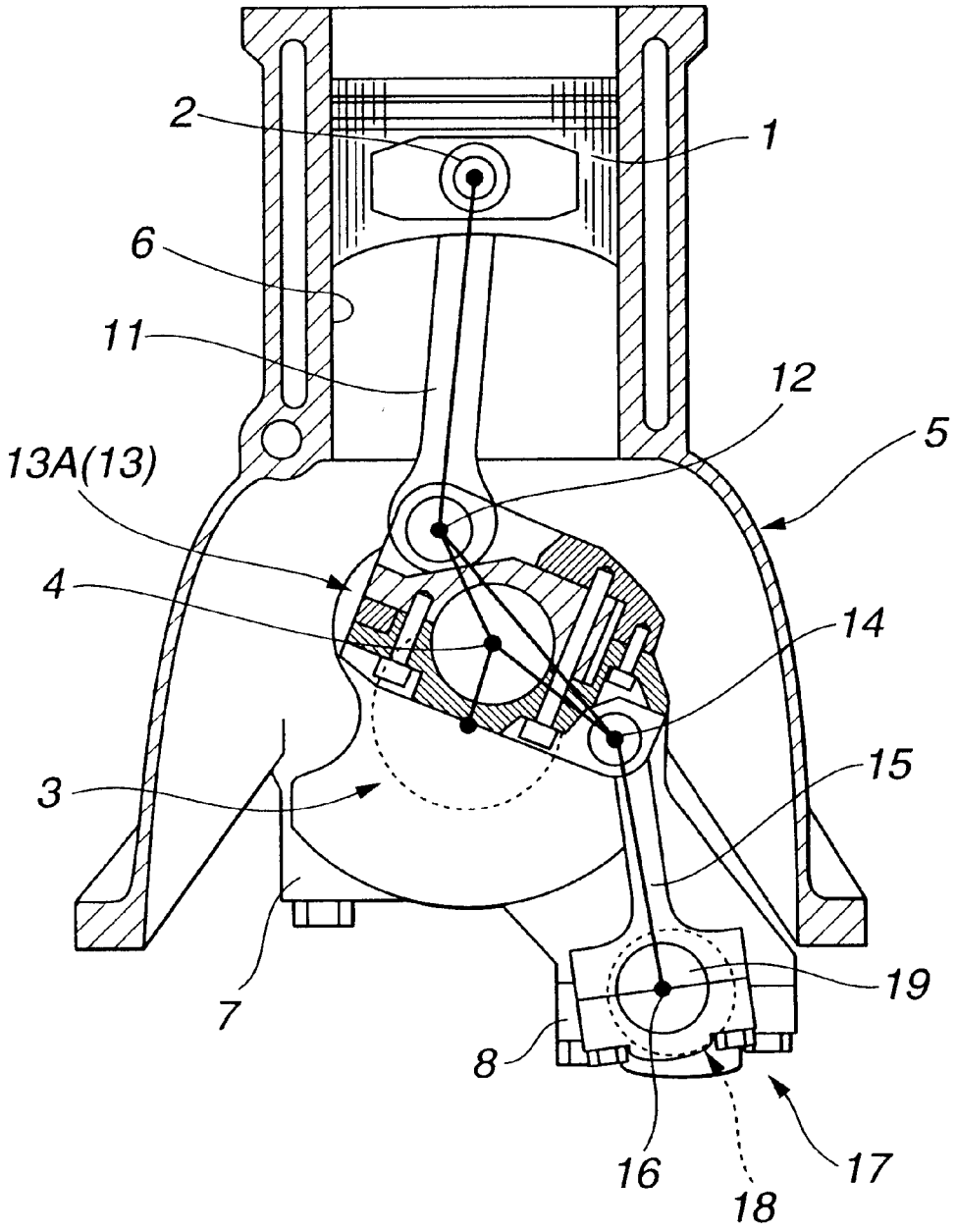
FIG. 1 is a cross-sectional view showing a first embodiment of the variable compression ratio mechanism of the invention.

Referring now to the drawings, particularly to FIG. 1, there is shown the detailed multi-link structure of the variable compression ratio mechanism of the first embodiment for a reciprocating internal combustion engine, in a state that an upper link 11, a lower link 13A (13), and a control link 15 are assembled to each other. A piston 1 is slidably fitted to a cylinder liner or a cylinder 6 formed in a cylinder block 5. Piston 1 is attached to one end of upper link 11 via a piston pin 2, to permit adequate freedom for movement between the piston and pin. The other end of upper link 11 is rotatably connected to lower link 13A by way of a first connecting pin 12. Lower link 13A is installed on the outer periphery of a crankpin 4 of an engine crankshaft 3. Piston 1 receives combustion pressure from a combustion chamber defined above its piston crown. Crankshaft 3 is rotatably installed onto cylinder block 5 by means of crankshaft bearing brackets 7. One end of control link 15 is rotatably connected to lower link 13A by means of a second connecting pin 14. The other end of control link 15, that is, the center (pivot axis) 16 of oscillating motion of control link 15 is pivotably supported by an engine body such as the cylinder block so as to permit a displacement of the center 16 of oscillating motion of control link 15 relative to the engine body. When changing a compression ratio of the engine, the center 16 of oscillating motion of control link 15 is shifted or displaced relative to the engine body by means of a support-position control mechanism (a support position changing means) 17. Support position changing means 17 includes a control shaft 18 that is driven or rotated about its axis when changing the compression ratio and a disk-shaped control cam 19 that is fixed to control shaft 18 and whose rotation axis is eccentric to the axis of control shaft 18. The other end of control link 15 is rotatably fitted to the outer periphery of control cam 19. Control shaft 18 is parallel to crankshaft 3 and extends in the cylinder-row direction. Control shaft 18 is rotatably supported by means of crankshaft bearing brackets 7 and control-shaft bearing brackets 8.

With the previously-noted arrangement, when control shaft 18 of support position changing means 17 is driven by an actuator (not shown) in order to change the compression ratio, the axis (rotation center) of control cam 19, corresponding to the center 16 of oscillating motion of control link 15, shifts relative to the engine body. As a result of this, a condition of restriction of motion of lower link 13A via control link 15 changes, and thus a crank angle versus piston stroke characteristic (containing the position of TDC and the position of BDC), that is, a compression ratio varies.

Figure 2:
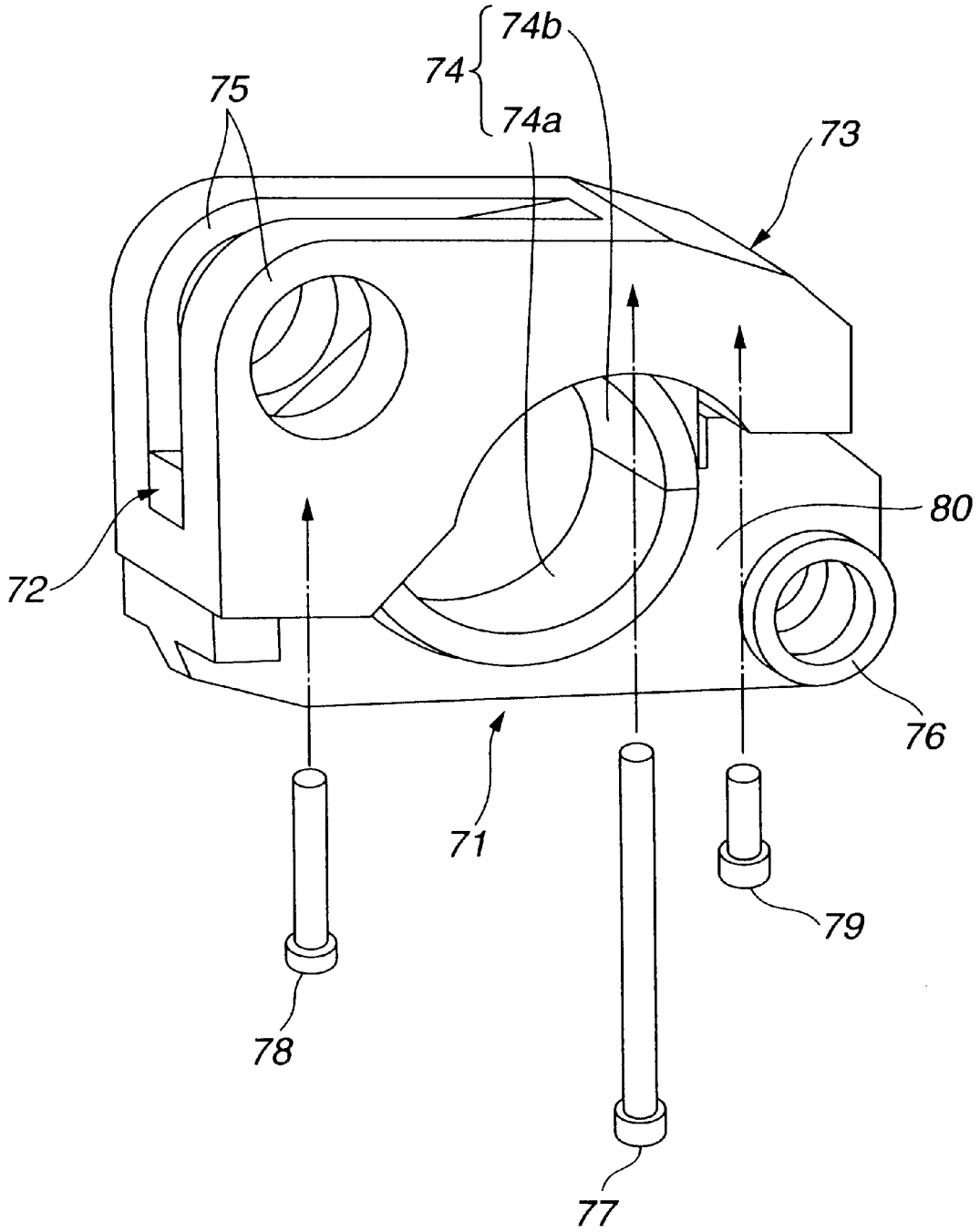
FIG. 2 is a perspective view showing only a lower link of the first embodiment.
Figure 3:
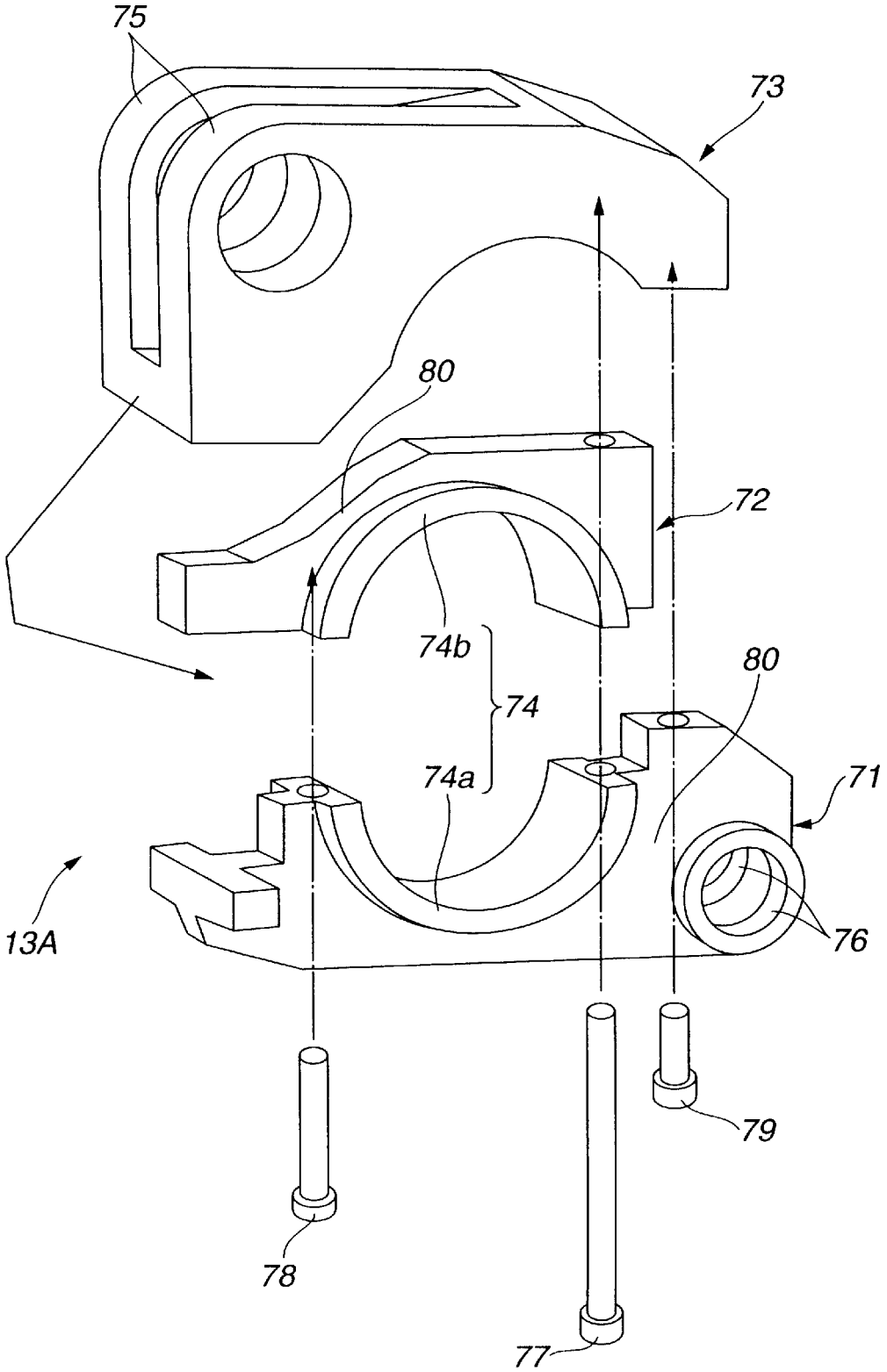
FIG. 3 is a disassembled perspective view of the lower link of the first embodiment.
Figure 4:
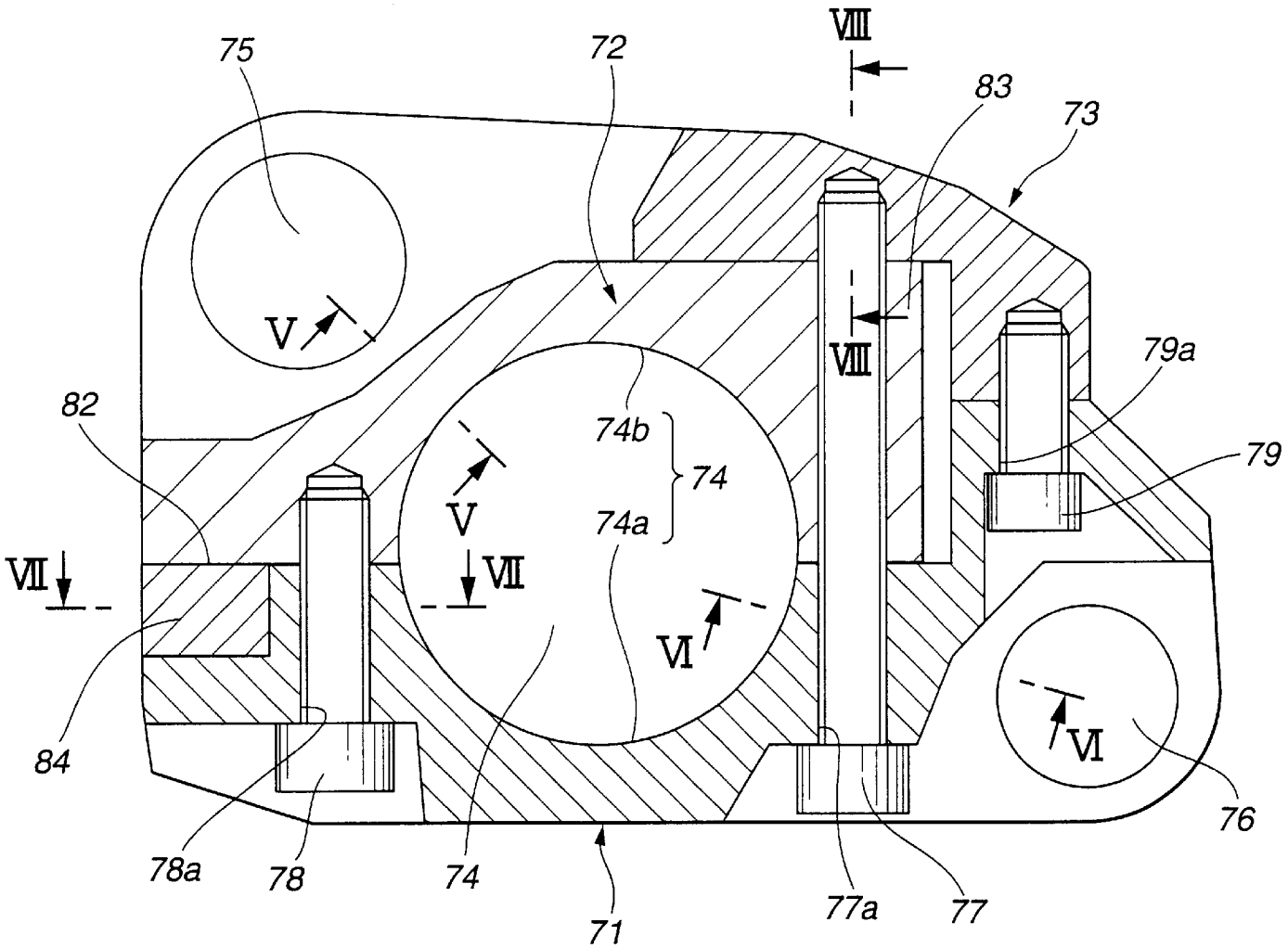
FIG. 4 is a cross-sectional view of the lower link shown in FIG. 2, cut at its axially central portion.
Figure 5:
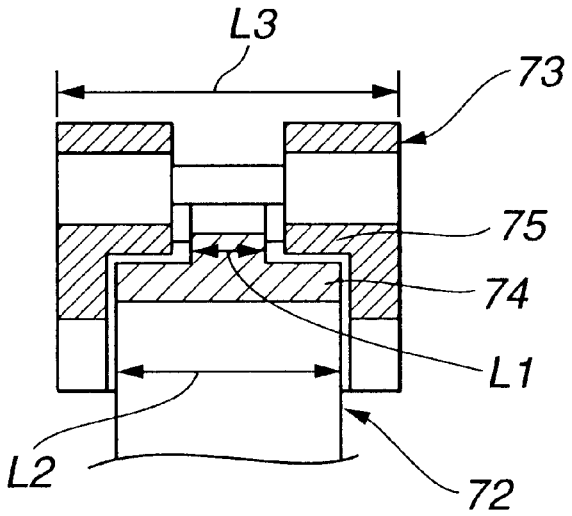
FIG. 5 is a cross section taken along the line V—V shown in FIG. 4.
Figure 6:
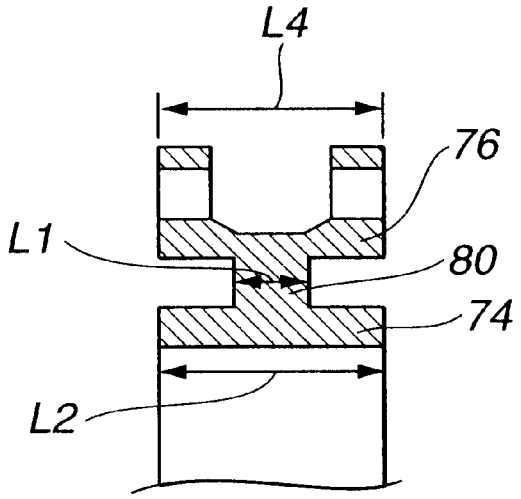
FIG. 6 is a cross section taken along the line VI—VI shown in FIG. 4.

Referring to FIGS. 2 through 10, there is shown the detailed structure of lower link 13A incorporated in the variable compression ratio mechanism of the first embodiment. Lower link 13A of the first embodiment has a three-split structure. Concretely, lower link 13A is mainly comprised of a first member 71, a second member 72, and a third member 73. Lower link 13A is formed with a substantially cylindrical crankpin bearing portion 74 into which crankpin 4 is fitted or inserted, a forked first connecting-pin bearing portion 75, whose axis is parallel to the axis of crankpin bearing portion 74 and into which first connecting pin 12 is inserted or fitted, and a substantially cylindrical second connecting-pin bearing portion 76, whose axis is parallel to the axis of crankpin bearing portion 74 and into which second connecting pin 14 is inserted or fitted. As best shown in FIGS. 2 and 3, crankpin bearing portion 74 is divided into two bearing halves, namely a first bearing half-round section (a lower half-round section in FIG. 4) 74*a* and a second bearing half-round section (an upper half-round section in FIG. 4) 74*b*. First member 71 is integrally formed with first bearing half-round section 74*a* and second connecting-pin bearing portion 76. Second member 72 is integrally formed with second bearing half-round section 74*b*. Third member 73 is integrally formed with first connecting-pin bearing portion 75. The first, second, and third members 71, 72, and 73 are integrally tightened or connected to each other in a direction normal to the axial direction of crankpin 4 by means of a first mounting bolt 77, a second mounting bolt 78, and an auxiliary mounting bolt (a third mounting bolt) 79, so that second member 72 is sandwiched by first and third members 71 and 73 as viewed from the direction normal to the axial direction of crankpin 4. First and second members 71 and 72 are formed with a central connecting portion 80 having a substantially constant axial length L1 (see FIGS. 5 and 6). Central connecting portion 80 corresponds to a central thick-walled portion that annularly surrounds the axial central portion of crankpin bearing portion 74. Concretely, central connecting portion 80 (the central thick-walled portion) is formed by radially increasing partly the thickness of the axial central portion of crankpin bearing portion 74. Central connecting portion 80 is integrally formed with crankpin bearing portion 74. As can be appreciated from the cross sections of FIGS. 5 and 6, the axial length L1 of central connecting portion or central thick-walled portion 80 is dimensioned to be shorter than each of an axial length L2 of crankpin bearing portion 74, an axial length L3 of first connecting-pin bearing portion 75, and an axial length L4 of second connecting-pin bearing portion 76. In the shown embodiment, please note that each of first and second connecting-pin bearing portions 75 and 76 is connected to crankpin bearing portion 74 via only the central connecting portion or central thick-walled portion 80. In more detail, as shown in FIGS. 5 and 9B, the axial central portion of crankpin bearing portion 74 and the axial central portion of second connecting-pin bearing portion 76 are connected to each other via only the central connecting portion 80. That is to say, only the central connecting portion 80 exists between crankpin bearing portion 74 and second connecting-pin bearing portion 76. In other words, crankpin bearing portion 74 and second connecting-pin bearing portion 76 cannot be connected to each other except via the central connecting portion 80. Due to connection between crankpin bearing portion 74 and second connecting-pin bearing portion 76 via central connecting portion 80, as appreciated from the analytical mechanics shown in FIG. 9B, the load transferred from second connecting-pin bearing portion 76 mainly acts on the axial central portion of crankpin bearing portion 74 via central connecting portion 80. Therefore, in the lower link structure of the first embodiment, there is a less possibility that the load is locally concentrated at both axial ends of crankpin bearing portion 74. Thus, as indicated by the phantom line or one-dotted line 74*a* in FIG. 9B, it is possible to adequately effectively suppress an undesired deformation of each of the axial ends of crankpin bearing portion 74. As a result, it is possible to avoid or suppress direct contact (metal-to-metal contact) between the axial ends of crankpin bearing portion 74 and crankpin 4, thus preventing extremely rapid wear and reducing friction. Actually, the load acting on the axial central portion of crankpin bearing portion 74 can be effectively reliably supported by way of the pressure of the lubricating oil film in the crankpin bearing portion, which pressure is relatively high at the axial central portion of crankpin bearing portion 74. In contrast to the above, in the first comparative example shown in FIG. 9A that a central connecting portion having a relatively short axial length does not exist between a crankpin bearing portion 74' and a connecting-pin bearing portion 76', the load applied to both axial ends of connecting-pin bearing portion 76' acts directly on both axial ends of crankpin bearing portion 74'. As a result, as indicated by the phantom line or one-dotted line 74*a*' in FIG. 9A, there is an increased tendency for the axial ends of crankpin bearing portion 74' to be undesirably remarkably deformed. The undesirable deformation of each axial end of crankpin bearing portion 74' may lead to direct contact (metal-to-metal contact) between the axial ends of crankpin bearing portion 74' and crankpin 4.

Figure 7:
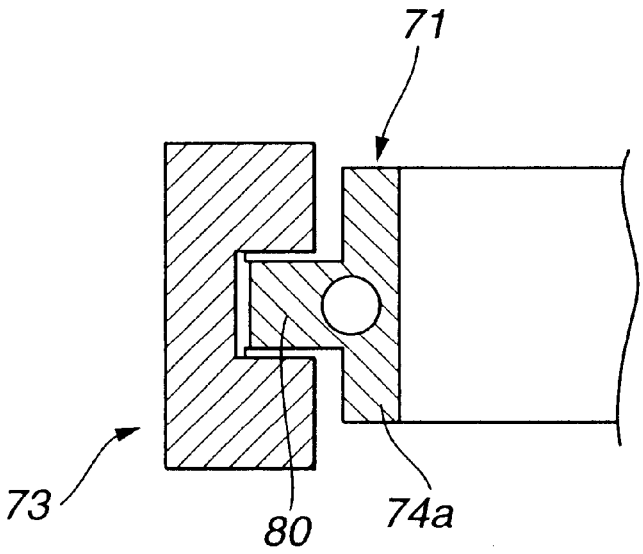
FIG. 7 is across section taken along the line VII—VII shown in FIG. 4.
Figure 8:
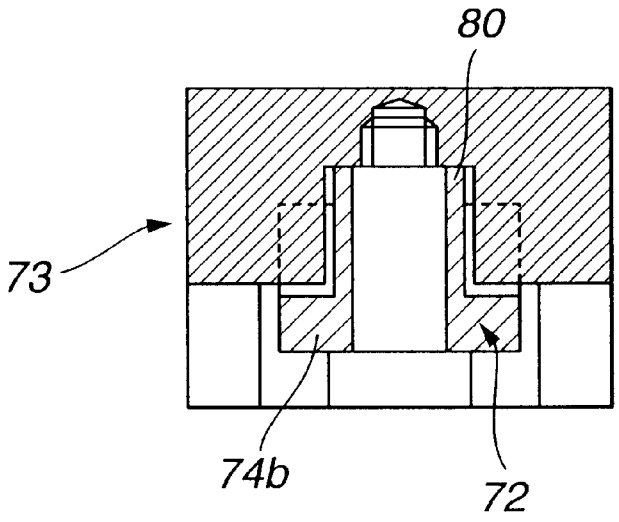
FIG. 8 is a cross section taken along the line VIII—VIII shown in FIG. 4.
Figure 9A:
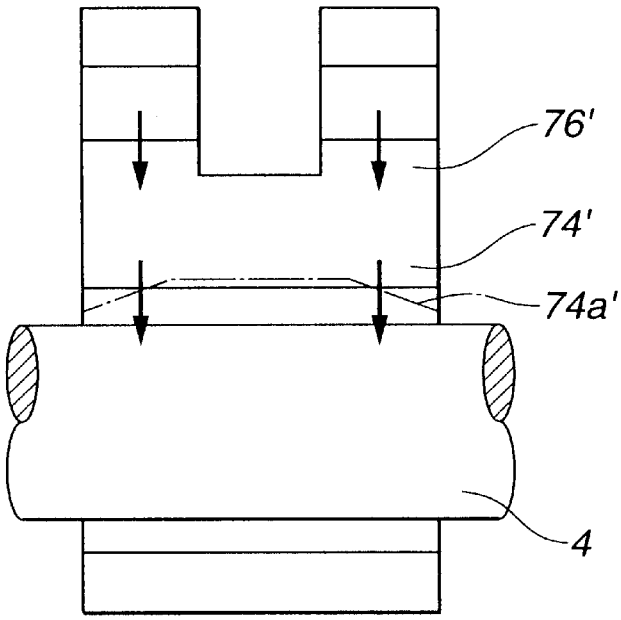
FIG. 9A is an explanatory drawing illustrating analytical mechanics (vector mechanics) for transmission of applied forces or loads via the lower link in a first comparative example.
Figure 9B:
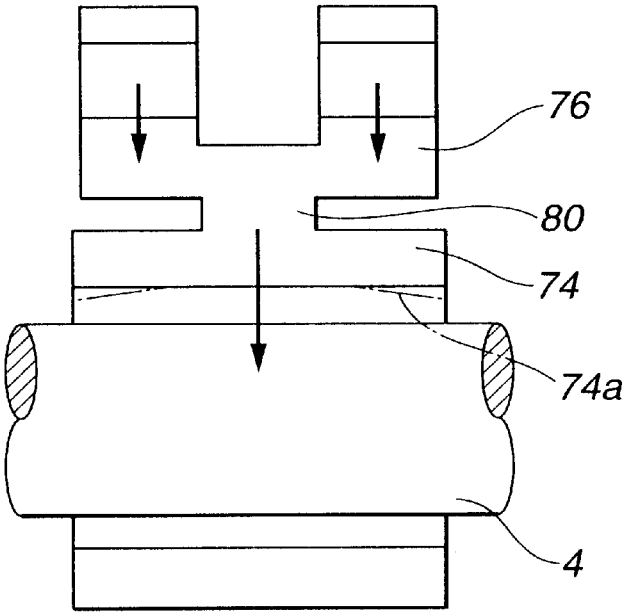
FIG. 9B is an explanatory drawing illustrating analytical mechanics (vector mechanics) for transmission of applied forces or loads via the lower link in the first embodiment.

As can be seen from the cross sections of FIGS. 5, 7, and 8, third member 73, which is formed with first connecting-pin bearing portion 75, is not in direct-contact with crankpin bearing portion 74. Actually, third member 73 is connected to crankpin bearing portion 74 via central connecting portion 80, which is formed as a central thick-walled portion that annularly surrounds the axial central portion of crankpin bearing portion 74. Inevitably, the load, which is applied to first connecting-pin bearing portion 75 acts on the axial central portion of crankpin bearing portion 74 via central connecting portion 80. Thus, there is no localized concentration of input load on both axial ends of crankpin bearing portion 74. That is, undesired deformation of the axial ends of crankpin bearing portion 74 can be sufficiently suppressed or avoided. As best seen in FIG. 3, third member 73, which is formed with first connecting-pin bearing portion 75, is formed as a separate part that is separated from each of first member 71, which is formed with first bearing half-round section 74*a* of crankpin bearing portion 74, and second member 72, which is formed with second bearing half-round section 74*b* of crankpin bearing portion 74. As discussed above, from the viewpoint of reduced stress concentration or reduced load concentration, the three-split lower link structure shown in FIGS. 2–8, and 10 is superior to a one-piece lower link that a crankpin bearing portion and a first connecting-pin bearing portion are integrally formed with each other. In particular, as shown in FIGS. 4 and 5, in an area that crankpin bearing portion 74 and first connecting-pin bearing portion 75 are radially opposed to each other, (a) second member 72, which is formed with crankpin bearing portion 74, (b) third member 73, which is formed with first connecting-pin bearing portion 75, and (c) central connecting portion 80 are kept in out of contact with each other. Therefore, the load applied to first connecting-pin bearing portion 75 is transmitted to central connecting portion 80, formed around crankpin bearing portion 74, via a contact portion or connected portion between first and third members 71 and 73 and via a contact or connected portion between second and third members 72 and 73. The contact portion or connected portion between first and third members 71 and 73 and the contact or connected portion between second and third members 72 and 73 are located at positions that are out of the previously-noted area that crankpin bearing portion 74 and first connecting-pin bearing portion 75 are radially opposed to each other. The input load is further transmitted via center connecting portion 80 to crankpin bearing portion 74. Owing to the input-load transmission as discussed above, it is possible to effectively reduce the localized concentration of input load particularly on the axial ends of each bearing portion. In other words, of first and second connecting-pin bearing portions 75 and 76, the first connecting-pin bearing portion 75, which has a relatively shorter center distance from the axis of crankpin bearing portion 74 in comparison with the second connecting-pin bearing portion 76 and via which a relatively greater input load is applied to crankpin bearing portion 74, is formed integral with third member 73, which is separable from each of first member 71, which is formed with first crankpin-bearing half-round section 74*a*, and second member 72, which is formed with second crankpin-bearing half-round section 74*b*. As described previously, crankpin bearing portion 74 has a two-split structure, namely first and second crankpin-bearing half-round sections 74*a* and 74*b*, and therefore crankpin bearing portion 74 can be installed on crankpin 4 after (at the later stage of assembly). Thus, it is possible to form crankshaft 3 integral with crankpins 4, and consequently to enhance the rigidity of the engine crankshaft.

Figure 10:
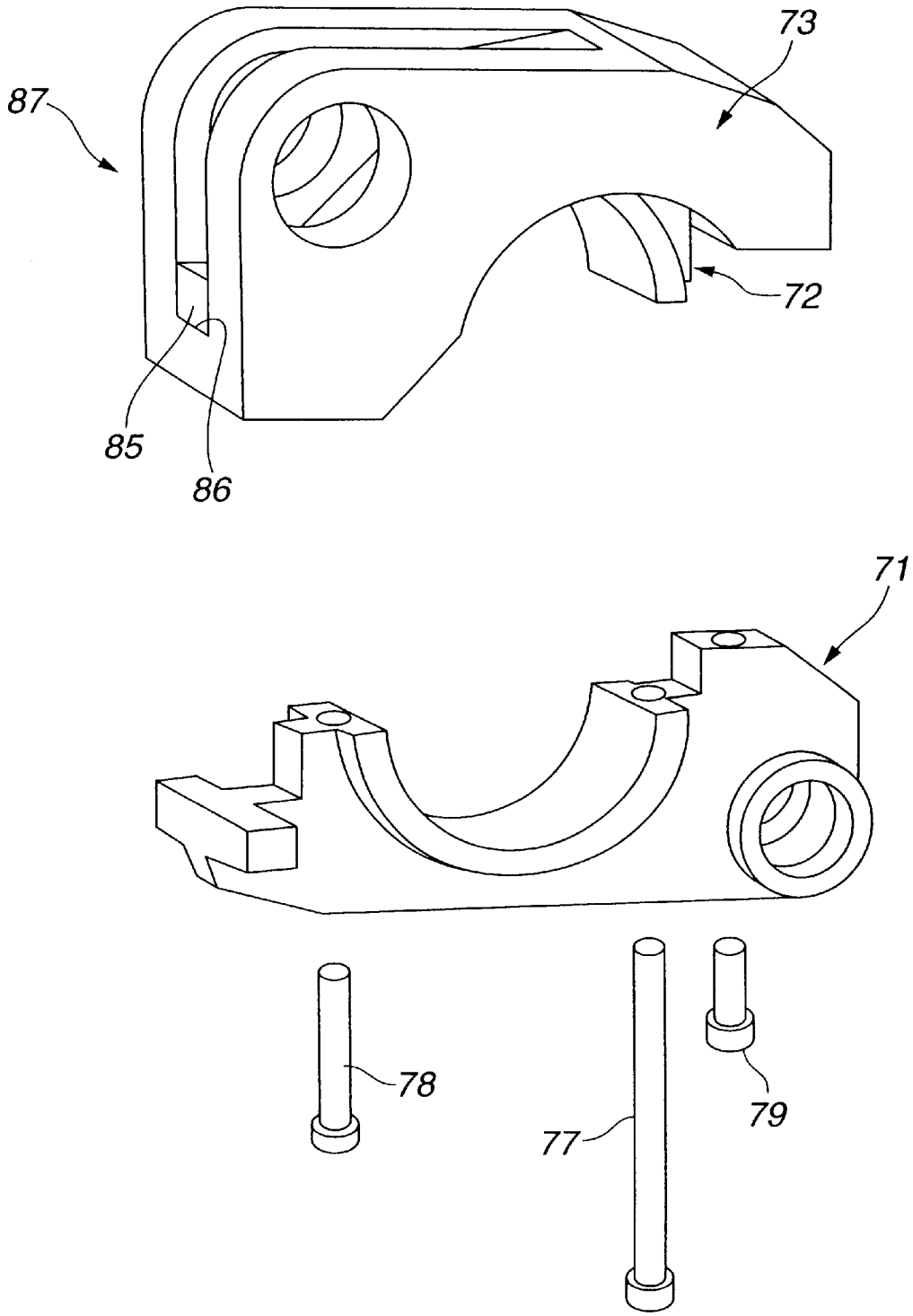
FIG. 10 is a perspective view showing assembly procedures for the lower link of the first embodiment.

Referring to FIG. 4, as a fixing device or a tightening device or a fastening device (a fixing means or a tightening means or a fastening means), first and second mounting bolts 77 ad 78 are arranged on both sides of crankpin bearing portion 74 in such a manner as to sandwich the crankpin bearing portion between them. First and second mounting bolts 77 and 78 extend in the direction normal to the axial direction of crankpin 4 from one side to the other side of a mating face 82 of first and second crankpin-bearing half-round sections 74*a* and 74*b*. First and second mounting bolts 77 and 78 functions to securely connect or fasten first and second crankpin-bearing half-round sections 74*a* and 74*b* to each other. Three members, namely first, second, and third members 71, 72, and 73 are fixedly connected or tightened to each other mainly by means of these mounting bolts 77 and 78. Concretely, first mounting bolt 77 penetrates a portion 83 of second member 72, i.e., a right-hand side second-member end (viewing FIG. 4), and functions to fasten or securely fix first member 71 to third member 73 in a state that the portion 83 of second member 72 is sandwiched and fixed securely between first and third members 71 and 73. On the other hand, second mounting bolt 78 functions to fasten or securely fix a portion of first member 71, i.e., a left-hand side first-member end to a portion of second member 72, i.e., a left-hand side second-member end (viewing FIG. 4). A portion 84 of third member 73 is sandwiched between the leftmost end portion of the left-hand side first member end and the leftmost end portion of the left-hand side second-member end. That is, second mounting bolt 78 serves to securely fix first member 71 to second member 72, sandwiching the portion 84 of third member 73 between the leftmost end portion of first member 71 and the leftmost end portion of second member 72. As set forth above, by means of a small number of mounting bolts, such as two mounting bolts 77 and 78, first, second, and third members 71, 72, and 73 are securely connected or tightened together. Additionally, as shown in FIG. 10, it is possible to temporarily assemble second and third members 72 and 73 as a sub-assembly or intermediate assembly 87 by fitting a portion 85 of second member 72 to a recessed portion 86 of third member 73. Thus, installation of the lower link on crankpin 4 can be easily made by integrally connecting intermediate assembly 87 (composed of second and third members 72 and 73 fitted to each other) to first member 71 by means of three bolts, that is, first and second mounting bolts 77 and 78, and auxiliary mounting bolt (third mounting bolt) 79. This facilitates the assembling work.

All of a bolt hole 77*a* for first mounting bolt 77, a bolt hole 78*a* for second mounting bolt 78, and a bolt hole 79*a* for auxiliary mounting bolt 79 open in the same direction (see the bolt holes formed in first member 71 having first bearing half-round section or lower half-round section 74*a*), i.e., in the downward direction (viewing FIG. 4). Therefore, during assembling of the lower link, these mounting bolts 77, 78, and 79 can be easily inserted into the respective bolt holes 77*a*, 78*a*, and 79*a* from the same direction. Additionally, the mounting bolts can be easily efficiently tightened, utilizing a comparatively space extending below the crankshaft. This ensures easy assembling. On the other hand, as appreciated from the right-hand side cross section of FIG. 4, auxiliary mounting bolt 79 functions to securely fix first member 71 to third member 73 near second connecting-pin bearing portion 76. As discussed above, auxiliary mounting bolt 79 is located in close proximity to second connecting-pin bearing portion 76, and therefore it is possible to enhance the rigidity and mechanical strength of second connecting-pin bearing portion 76 itself.

Figure 11:
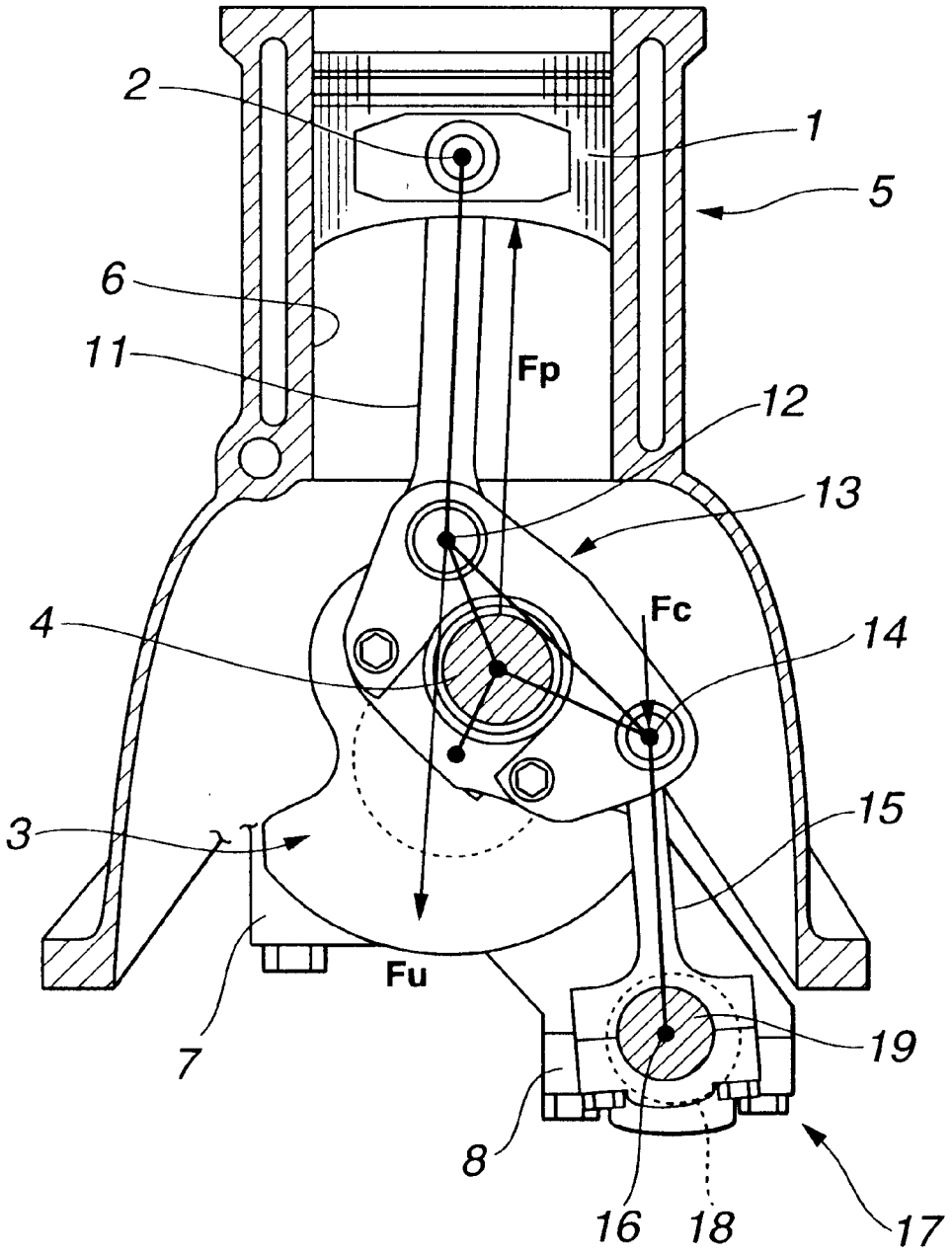
FIG. 11 is a cross-sectional view showing a second embodiment of the variable compression ratio mechanism of the invention.

Referring now to FIG. 11, there is shown the detailed multi-link structure of the variable compression ratio mechanism of the second embodiment for a reciprocating internal combustion engine, in a state that upper link 11, lower link 13, and control link 15 are assembled to each other. The multi-link structure of the second embodiment is similar to that of the first embodiment, except that a lower link structure (lower link 13) of the second embodiment is somewhat different from that of the first embodiment. Thus, the same reference signs used to designate elements of the variable compression ratio mechanism of the first embodiment shown in FIGS. 1–10 will be applied to the corresponding elements of the second embodiment shown in FIGS. 11–17C and 18B, for the purpose of comparison of the first and second embodiments.

Figures 12A, 12B, 12C, 12D:
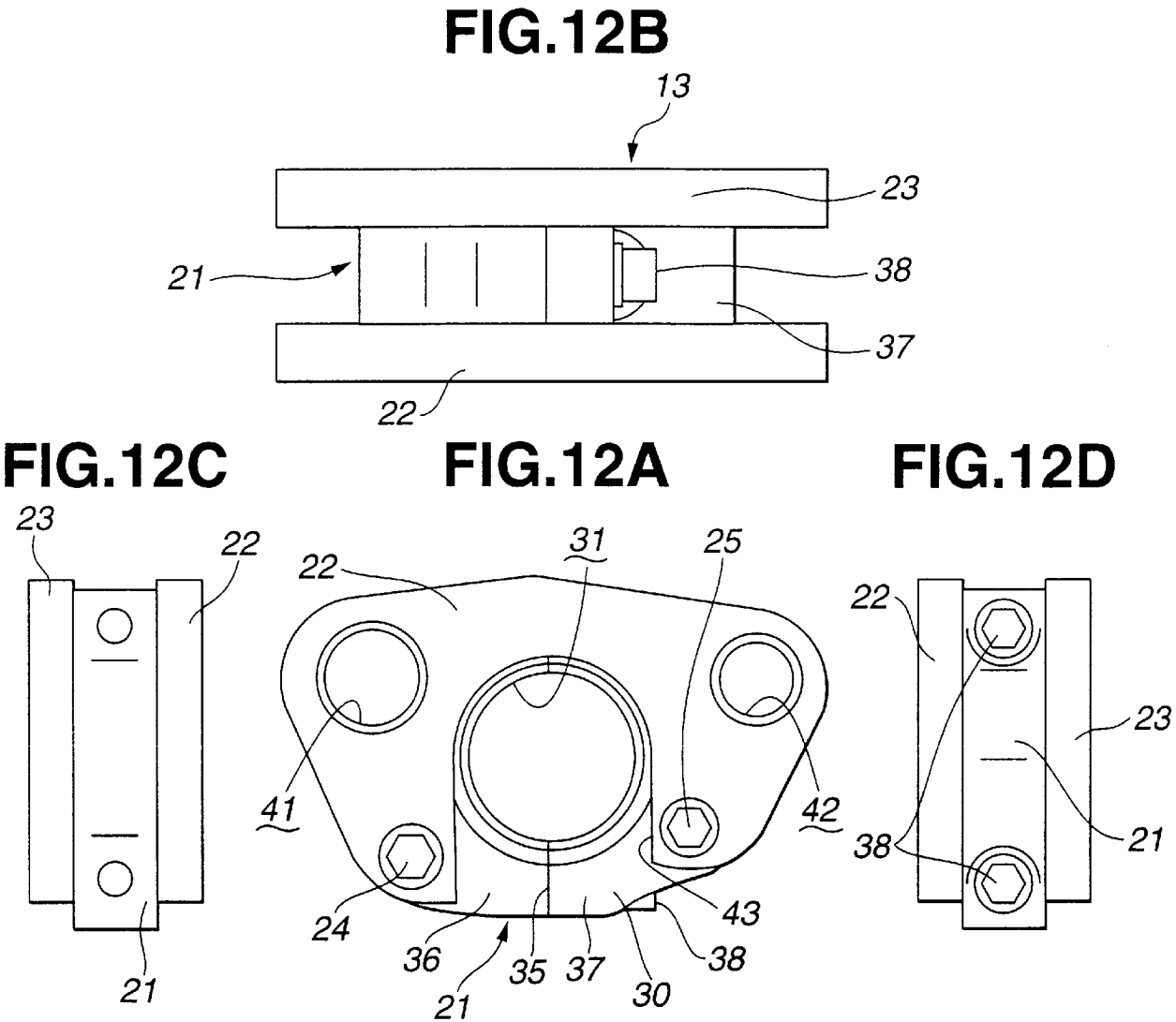
FIG. 12A is a front elevation view showing a lower link of the second embodiment.
FIG. 12B is a top view showing the lower link of the second embodiment.
FIG. 12C is a left-hand side view showing the lower link of the second embodiment.
FIG. 12D is a right-hand side view showing the lower link of the second embodiment.
Figure 13:
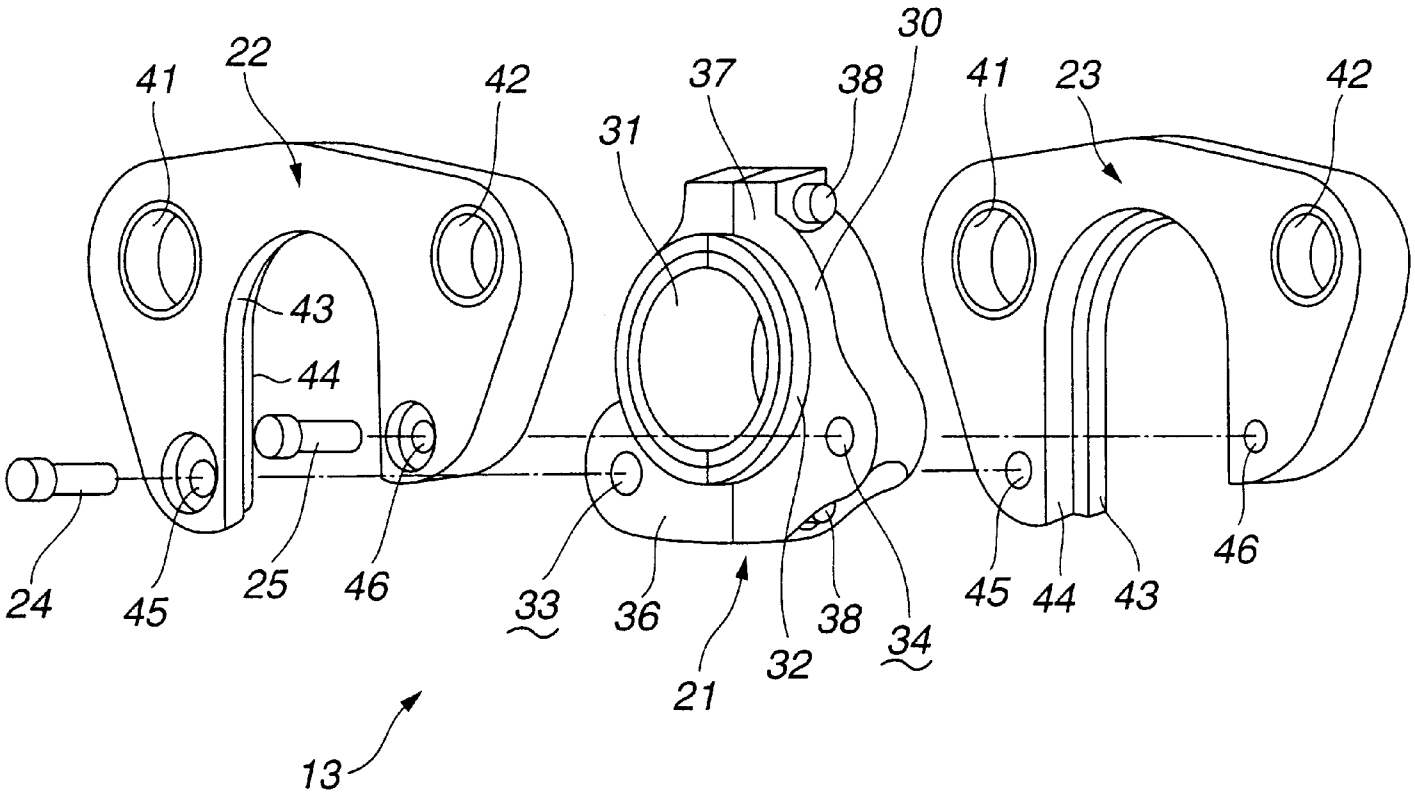
FIG. 13 is a disassembled perspective view of the lower link of the second embodiment.

Referring now to FIGS. 12A–12B, and 13, there is shown the detailed structure of lower link 13 incorporated in the variable compression ratio mechanism of the second embodiment. Lower link 13 of the second embodiment has a four-split structure. Concretely, lower link 13 is mainly comprised of a crankpin bearing member 21, a pair of connecting-pin bearing members 22 and 23. As described later, crankpin bearing member 21 is further divided into two separate parts, namely first and second divided sections 36 and 37. Crankpin bearing member 21 serves to rotatably support crankpin 4. The connecting-pin bearing member pair (22, 23) serves to rotatably support first and second connecting pins 12 and 14. These members 21, 22, and 23 are securely connected or tightened to each other by means of a pair of bearing member mounting bolts 24 and 25, such that crankpin bearing member 21 is placed or sandwiched between connecting-pin bearing members 22 and 23 as viewed from the axial direction of crankpin 4.

Figure 14A:
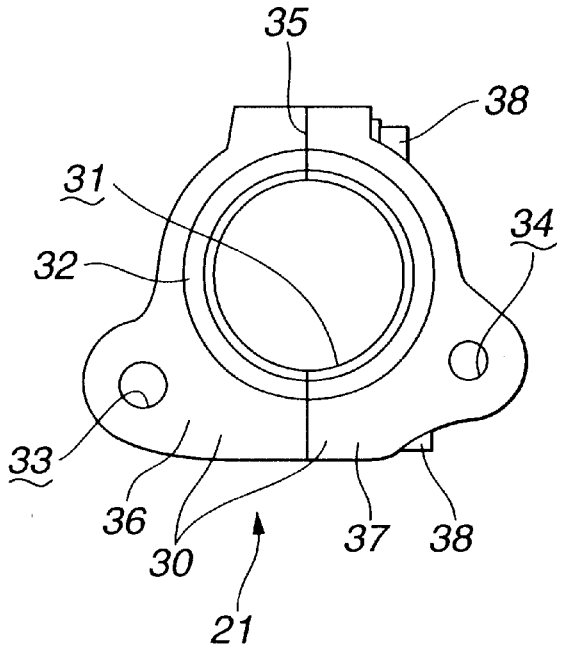
FIG. 14A is a front elevation view showing only a crankpin bearing member of the second embodiment.
Figure 14B:
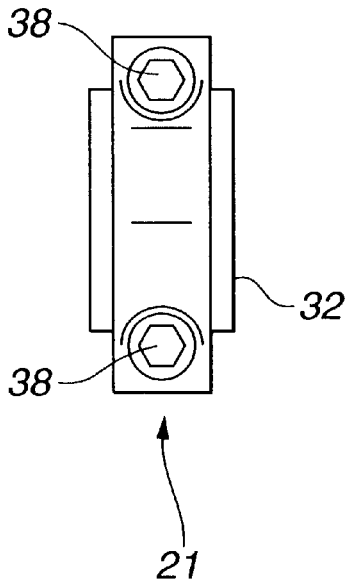
FIG. 14B is a right-hand side view of the crankpin bearing member of the second embodiment.

FIGS. 14A and 14B show the detailed structure of crankpin bearing member 21. Crankpin bearing member 21 is formed with a crankpin bearing surface 31 onto which the crankpin (the bearing journal portion) is fitted. In order to assure an adequate bearing strength, an axial length of a crankpin bearing portion 32, which is formed as a cylindrical portion that annularly surrounds crankpin bearing surface 31, is dimensioned to be relatively longer than an axial length of the other portion 30 of crankpin bearing member 21. That is to say, the other portion of crankpin bearing member 21 is formed as a central connecting portion 30 that annularly surrounds the axial central portion of crankpin bearing portion 32 and has a constant thickness in the axial direction of crankpin 4. Central connecting portion 30 constructs or forms an axial central portion of crankpin bearing surface 31. In other words, crankpin bearing portion 32 is formed in a manner so as to protrude from central connecting portion 30. As best seen in FIG. 14A, central connecting portion 30 is formed integral with a pair of radially outward extending eared portions. A first bolt hole 33 for bearing member mounting bolt 24 and a second bolt hole 34 for bearing member mounting bolt 25 are formed in the respective eared portions as axial through openings parallel to the axis of crankpin 4. As best seen in FIGS. 13 and 14A, crankpin bearing member 21 is divided into the first and second divided sections 36 and 37 by a mating surface 35 that passes the axis of the cylindrical crankpin bearing surface 31 and is parallel to the axis of crankpin 4. As discussed above, crankpin bearing member 21 has a two-split structure, namely first and second divided sections 36 and 37 that are integrally connected to each other by means of divided-section connecting bolts (38, 38), and therefore crankpin bearing member 21 can be installed on crankpin 4 after (at the later stage of assembly). For the reasons set forth above, first divided section 36 is formed with a first half-round section of crankpin bearing portion 32 and first bolt hole 33 for bearing member mounting bolt 24, whereas second divided section 37 is formed with a second half-round section of crankpin bearing portion 32 and second bolt hole 34 for bearing member mounting bolt 25.

Figure 15C:
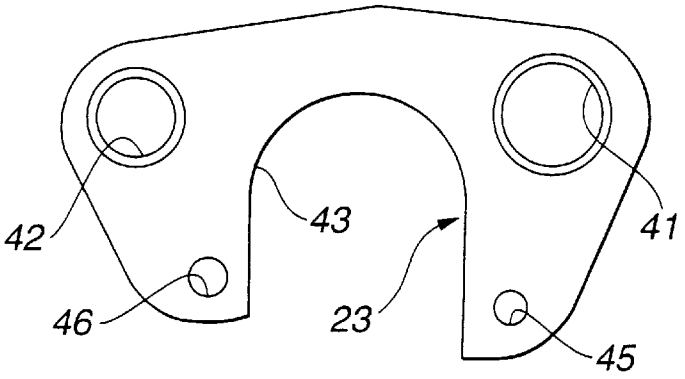
FIGS. 15A and 15C are front elevation views showing a pair of connecting-pin bearing members of the second embodiment.
Figure 15D:
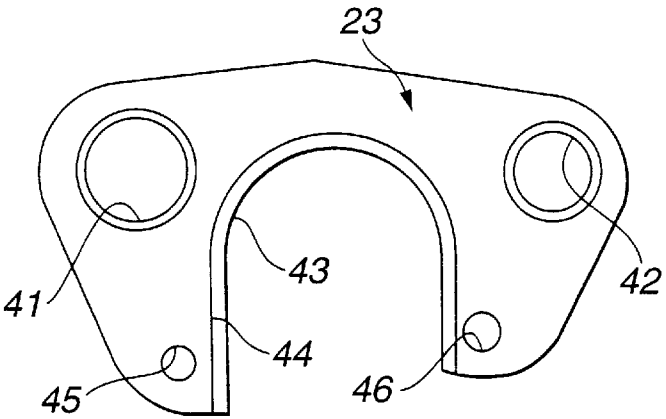
FIGS. 15B and 15D are back views showing the pair of connecting-pin bearing members of the second embodiment.
Figure 15A:
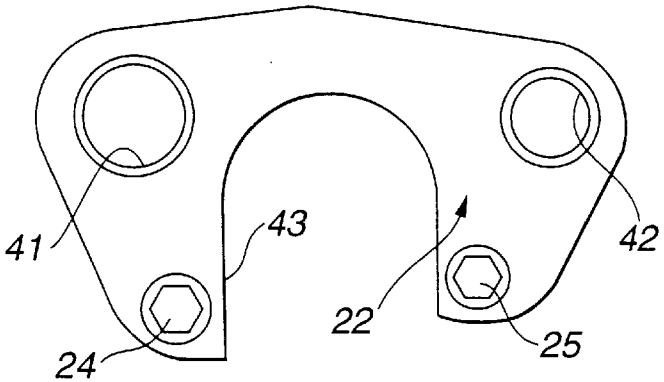
Figure 15B:
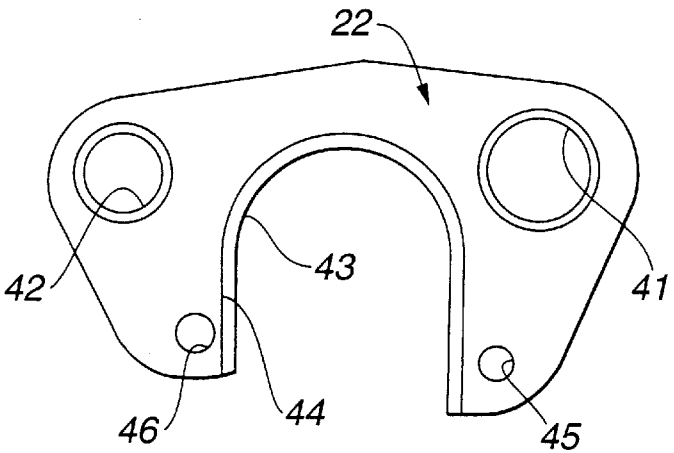

FIGS. 15A and 15B show the detailed structure of connecting-pin bearing member 22, whereas FIGS. 15C and 15D show the detailed structure of connecting-pin bearing member 23. The shapes are almost the same in connecting-pin bearing members 22 and 23. As best shown in FIG. 13, each of connecting-pin bearing members 22 and 23 is a plate-like or plate-shaped member. Each of connecting-pin bearing members (the plate-shaped members) 22 and 23 is integrally formed with a first connecting-pin bearing portion 41 having a bearing surface onto which first connecting pin 12 is fitted and a second connecting-pin bearing portion 42 having a bearing surface onto which second connecting pin 14 is fitted. That is, the previously-discussed connecting-pin bearing portion for first connecting pin 12 is comprised of a pair of axially aligned bearing portions (41, 41) formed integral with the respective connecting-pin bearing members 22 and 23. Similarly, the previously-discussed connecting-pin bearing portion for second connecting pin 14 is comprised of a pair of axially aligned bearing portions (42, 42) formed integral with the respective connecting-pin bearing members 22 and 23. Each of connecting-pin bearing members 22 and 23 is also formed with a substantially U-shaped primary cut-out portion 43 that is required to avoid or prevent undesired interference or contact between crankpin 4 and each connecting-pin bearing member (22, 23). In order to avoid undesired interference or contact with crankpin bearing surface 32, each of connecting-pin bearing members 22 and 23 is further formed with a secondary cut-out portion 44 in close proximity to primary cut-out portion 43 to provide a substantially U-shaped stepped cut-out. Additionally, connecting-pin bearing member 22 is formed with two bolt holes, namely a counter-bored bolt hole 45 for bearing member mounting bolt 24 and a counter-bored bolt hole 46 for bearing member mounting bolt 25 (see FIGS. 15A and 15B and the left-hand side of FIG. 13). On the other hand, connecting-pin bearing member 23 is formed with two bolt holes, namely a female screw-threaded bolt hole 45 for bearing member mounting bolt 24 and a female screw-threaded bolt hole 46 for bearing member mounting bolt 25 (FIGS. 15C and 15D and the right-hand side of FIG. 13). As shown in FIGS. 12A–12D, in a state that connecting-pin bearing member 22, crankpin bearing member 21, and connecting-pin bearing member 23 are assembled to each other by means of two bearing member mounting bolts 24 and 25, each connecting-pin bearing member (22, 23) is in contact with crankpin bearing member 21 only via the bolted portion and the axially opposing surfaces. In other words, each connecting-pin bearing member (22, 23) is out of contact with crankpin bearing member 21 except the bolted portion and the axially opposing surfaces. That is to say, each connecting-pin bearing member (22, 23) and crankpin bearing member 21 are kept in non-contact with each other in the direction normal to the axial direction of crankpin 4. More concretely, a predetermined clearance is provided between the outer periphery of crankpin 4 and primary cut-out surface 43 and between crankpin bearing portion 32 and secondary cut-out surface 44 to avoid undesirable contact between crankpin 4 and each connecting-pin bearing member (22, 23) even in presence of deformation of each member owing to the applied load.

As clearly shown in FIGS. 12A and 15A–15D (as viewed from the axial direction of crankpin 4), the positions of bearing member mounting bolts 24 and 25 that integrally connect connecting-pin bearing member 22, crankpin bearing member 21, and connecting-pin bearing member 23 to each other (or the positions of bolt holes 45 and 46) are arranged away from the installation positions of first and second connecting pins 12 and 14 (or the positions of connecting-pin bearing portions 41 and 42). That is, crankpin bearing member 21 and each of connecting-pin bearing members 22 and 23 are integrally connected at positions spaced apart from connecting-pin bearing portions 41 and 42. Concretely, as appreciated from the front elevation views of FIGS. 15A–15D and 12A (as viewed from the axial direction of crankpin 4), bolt hole 46 (for bearing member mounting bolt 25) and first connecting-pin bearing portion 41 are substantially point-symmetrical with respect to the axis of crankpin bearing surface 31. Bolt hole 45 (for bearing member mounting bolt 24) and second connecting-pin bearing portion 42 are substantially point-symmetrical with respect to the axis of crankpin bearing surface 31. Furthermore, first and second connecting-pin bearing portions 41 and 42 are arranged substantially symmetrically with respect to the mating surface 35 of first and second divided sections 36 and 37. As best seen in FIG. 12A, two connecting-pin bearing portions 41 and 42 (or axes of connecting-pin bearing portions 41 and 42), and crankpin bearing portion 32 (axis of crankpin bearing portion 32) or crankpin bearing surface 31 (axis of crankpin bearing surface 31) triangularly arranged with each other. That is, the axis of crankpin bearing portion 32 (crankpin bearing surface 31) is offset from the intersection point between the mating surface 35 and the line segment that interconnects the axes of first and second connecting-pin bearing portions 41 and 42. In other words, the two connecting-pin bearing portions 41 and 42 are arranged or offset away from the opening of substantially U-shaped primary cut-out portion 43. In FIGS. 15A–15D, connecting-pin bearing portions 41 and 42 are offset or positioned above the axis of crankpin bearing surface 31 (the axis of crankpin bearing portion 32 or the axis of crankpin 4). Owing to the relative position relationship among connecting-pin bearing portions 41 and 42, bolt holes 45 and 46, and crankpin bearing portion 32, two bolt holes 45 and 46 are substantially symmetrical with respect to the mating surface 35. Additionally, the axis of crankpin bearing portion 32 (crankpin bearing surface 31) is offset from the intersection point between the mating surface 35 and the line segment that interconnects the axes of bolt holes 45 and 46. In other words, the two bolt holes 45 and 46 are arranged or offset toward the opening of substantially U-shaped primary cut-out portion 43. In FIGS. 15A–15D, bolt holes 45 and 46 are offset or positioned below the axis of crankpin bearing surface 31 (the axis of crankpin bearing portion 32 or the axis of crankpin 4).

Figure 16A:
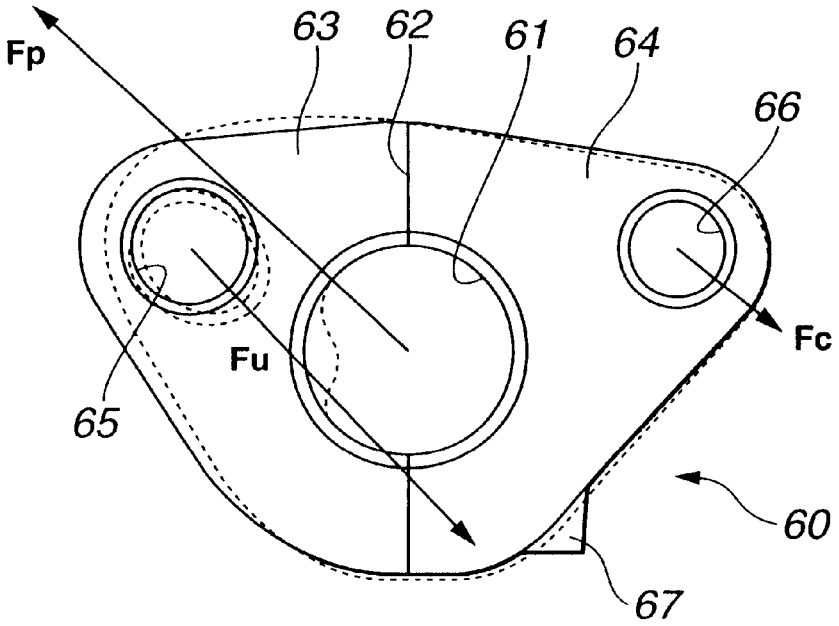
FIG. 16A is a front elevation view showing the lower link of the second comparative example.
Figure 16B:
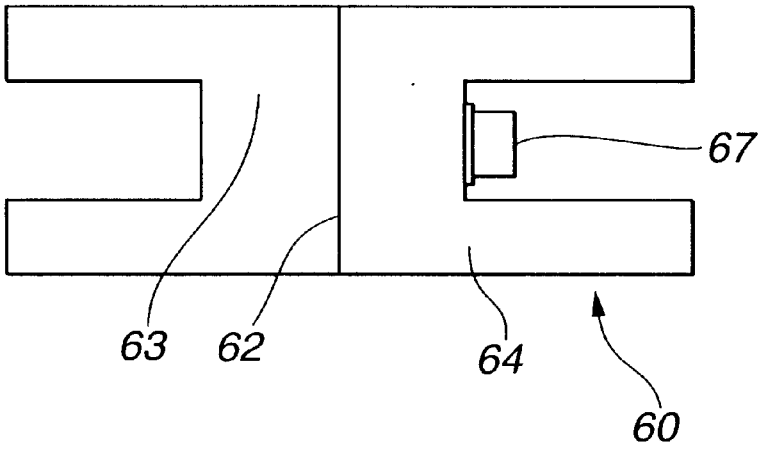
FIG. 16B is a top view showing the lower link of the second comparative example.
Figures 17A, 17B, 17C:
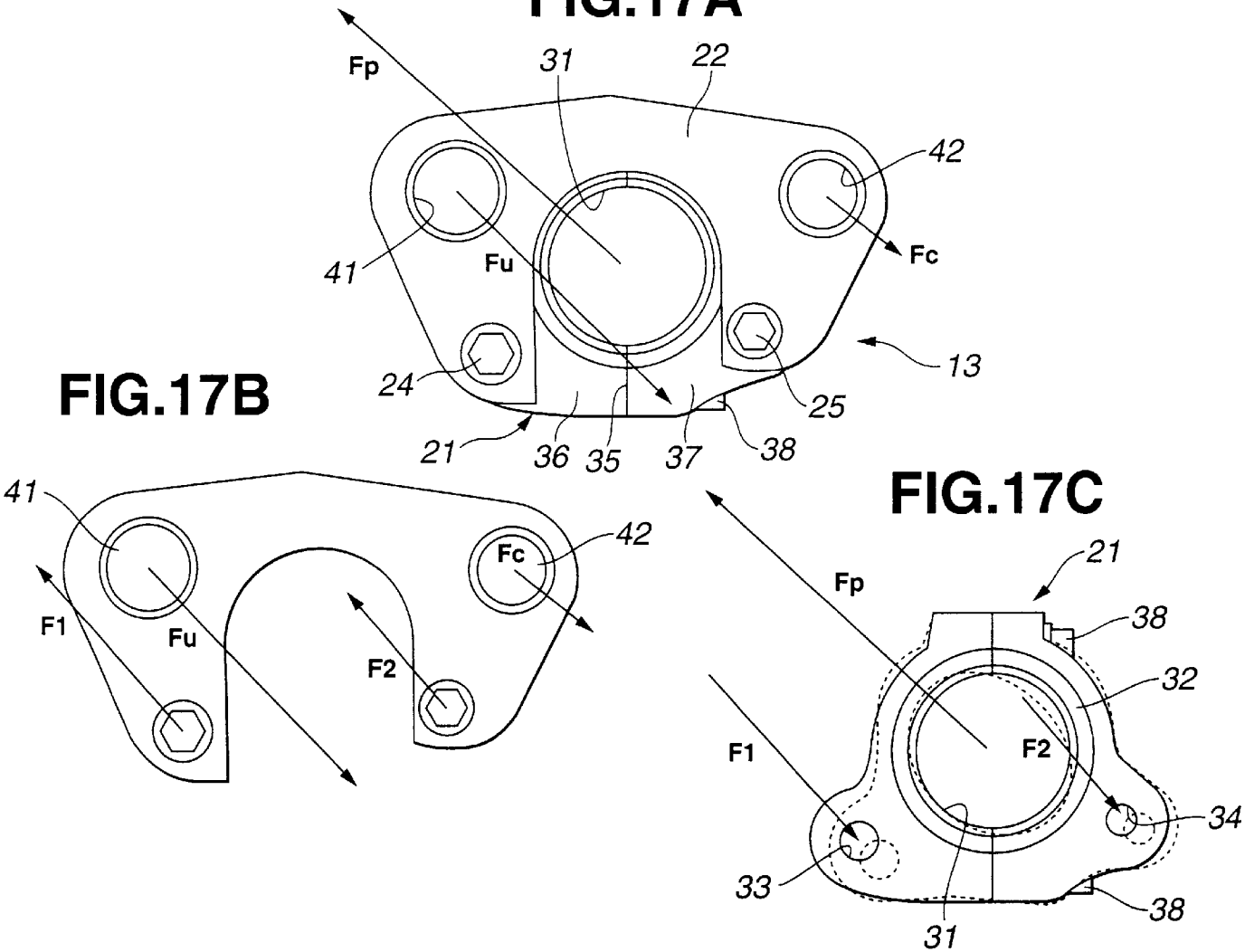
FIG. 17A is an explanatory drawing illustrating analytical mechanics (vector mechanics) for transmission of applied forces or loads via the lower link in the second embodiment.
FIG. 17B is an explanatory drawing illustrating analytical mechanics (vectormechanics) for transmission of applied forces or loads via the connecting-pin bearing member in the second embodiment.
FIG. 17C is an explanatory drawing illustrating analytical mechanics (vector mechanics) for transmission of applied forces or loads via the crankpin bearing member in the second embodiment.
Figure 18A:
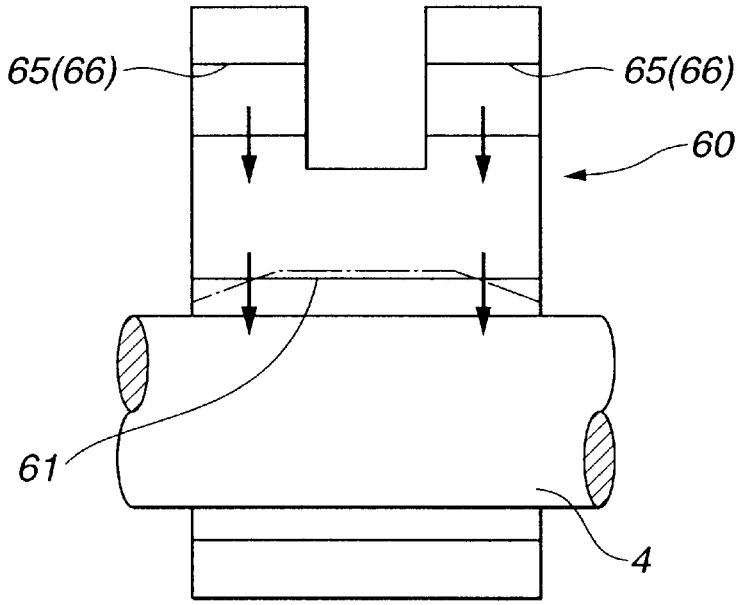
FIG. 18A is an explanatory drawing illustrating analytical mechanics (vector mechanics) for transmission of applied forces or loads via the lower link in a second comparative example.

FIGS. 17A–17C and 18B show the structure of lower link 13 of the second embodiment, while FIGS. 16A–16B and 18A show the structure of a lower link 60 of the second comparative example that lower link 60 is split into a pair of divided sections 63 and 64 along a mating surface 62 passing the axis of a crankpin bearing portion 61. Divided sections 63 and 64 are installed on the crankpin, by tightening a sole divided-section mounting bolt 67, sandwiching the crankpin between the divided sections. The first divided section 63 is formed with a connecting-pin bearing portion 65 and a first half-round section of crankpin bearing portion 61, whereas the second divided section 64 is formed with a connecting-pin bearing portion 66 and a second half-round section of crankpin bearing portion 61. The difference of operation and effects between the second embodiment and the second comparative example will be hereunder described in detail in reference to FIGS. 16A–16B and 18A related to the second comparative example and FIGS. 11, 17A–17C and 18B related to the second embodiment.

As best seen in FIG. 11, a load Fu, which acts on the lower link via the upper link, is input in the axial direction of the upper link, whereas a load Fc, which acts on the lower link via the control link, is input in the axial direction of the control link. As a reaction force (push-back force), a load Fp is input or applied to the crankpin from the lower link. The directions of these loads Fu, Fc, and Fp change depending upon engine operating conditions and the stroke position of the reciprocating piston. Hereinafter described in reference to FIGS. 16A, and 17A–17C is the analytical mechanics under a condition that the input load Fu acts toward the crankpin bearing portion.

In the second comparative example, first connecting-pin bearing portion 65 and first half-round section of crankpin bearing portion 61 are formed integral with first divided section 63, and therefore the input load Fu and input load Fp act directly on a part of crankpin bearing portion 61. As appreciated from the broken line in FIG. 16A, owing to application of input loads Fu and Fp, crankpin bearing portion 61 tends to be locally deformed. As discussed above, in the second comparative example that first connecting-pin bearing portion 65 and first half-round section of crankpin bearing portion 61 are formed integral with first divided section 63, assuming that first connecting-pin bearing portion 65 is positioned close to crankpin bearing portion 61, there results in localized concentration of input load on the crankpin bearing portion, thus increasing localized deformation. The localized deformation of crankpin bearing portion 61 causes a change in the shape of the sliding surface, thus deteriorating the sliding motion (sliding state) of the crankpin. This results in increased wear and friction at the metal-to-metal contact portion between the outer periphery of the crankpin and the inner periphery of the crankpin bearing portion. In contrast to the above, in the lower link structure of the second embodiment, first connecting-pin bearing member 22, crankpin bearing member 21, and second connecting-pin bearing member are formed as separate parts that are separable from each other, and additionally each connecting-pin bearing member (22, 23) and crankpin bearing portion 32 of crankpin bearing member 21 are kept in non-contact with each other in the direction normal to the axial direction of crankpin 4. Thus, there is no possibility that the input load Fu and input load Fc act directly on a part of crankpin bearing portion 32. That is, loads F1 and F2 input from the connecting-pin bearing member pair (22, 23) to crankpin bearing member 21 can be effectively divided or dispersed into installation portions of bearing member mounting bolts 24 and 25 (in other words, portions of first bolt hole 33 of bearing member mounting bolt 24 and second bolt hole 34 of bearing member mounting bolt 25). The portion of first bolt hole 33 on which input load F1 acts and the portion of second bolt hole 34 on which input load F2 acts are positioned apart from crankpin bearing surface 31 or crankpin bearing portion 32. Therefore, it is possible to properly circumferentially disperse the input load acting on crankpin bearing surface 31. As indicated by the broken line in FIG. 17C, the localized deformation of crankpin bearing surface 31 can be effectively reduced in comparison with the second comparative example. Also, the portion of first bolt hole 33 on which input load F1 acts and the portion of second bolt hole 34 on which input load F2 acts are bolt-connected portions, and thus have a relatively higher rigidity than first and second connecting-pin bearing portions 41 and 42 or portions proximate to these connecting-pin bearing portions 41 and 42. This effectively suppresses or reduces the magnitude of localized deformation, thus suppressing or decreasing undesirable localized deformation of the shape of the sliding surface of crankpin bearing surface 31. This assures a smooth sliding motion or smooth sliding state. In other words, it is possible to effectively avoid undesirable metal-to-metal contact between the outer periphery of crankpin 4 and the inner periphery of crankpin bearing portion 32, thus reducing wear and friction. In designing crankpin bearing portion 32 formed with crankpin bearing surface 31, it is possible to provide a required machine design strength or rigidity mainly by taking into account the rigidity of crankpin bearing portion 32 adequate to the magnitude of reaction force Fp. As a result, the required design rigidity for crankpin bearing portion 32 can be designed or set to a comparatively low rigidity. This leads to lightening of the lower link structure. Additionally, as clearly seen in FIGS. 15A–15D, a first cylindrical connecting-pin bearing section of first connecting-pin bearing portion 41 and a first cylindrical connecting-pin bearing section of second connecting-pin bearing portion 42 are integrally formed with first connecting-pin bearing member 22 (see FIGS. 15A and 15B), whereas a second cylindrical connecting-pin bearing section of first connecting-pin bearing portion 41 and a second cylindrical connecting-pin bearing section of second connecting-pin bearing portion 42 are integrally formed with second connecting-pin bearing member 23 (see FIGS. 15C and 15D). This enhances the accuracy of relative position between first and second connecting-pin bearing portions 41 and 42. Additionally, bearing member mountingbolts 24 and 25, by means of which crankpin bearing member 21 and each connecting-pin bearing member (22, 23) are integrally connected, are substantially symmetrical with respect to the mating surface 35 of first and second divided sections 36 and 37. These mounting bolts 24 and 25 serve as a mechanical support or mechanical strength member withstanding or opposing the force or bending stress that acts to open the mating surface 35 via the connecting-pin bearing members. As a consequence, it is possible to reduce a required rigidity and strength of divided-section connecting bolt 38 and a portion around the divided-section connecting bolt. This enables downsizing and lightening of the lower link.

Figure 18B:
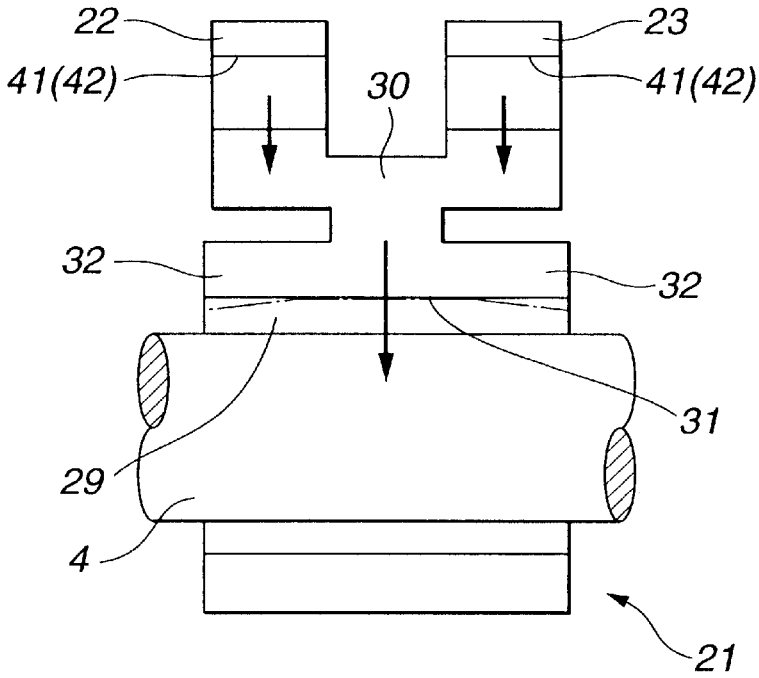
FIG. 18B is an explanatory drawing illustrating analytical mechanics (vector mechanics) for transmission of applied forces or loads via the lower link in the second embodiment.

Additionally, in the lower link structure of the second comparative example, pin-boss portions of lower link 60 that form or provide first and second connecting-pin bearing portions 65 and 66 are formed as forked pin-boss portions, such that the upper link is assembled on the forked end of the pin-boss portion associated with first connecting-pin bearing portion 65, and that the control link is assembled on the forked end of the pin-boss portion associated with second connecting-pin bearing portion 66. The central connecting portion as discussed previously doe not exist between each connecting-pin bearing portion (65, 66) and crankpin bearing portion 61. The reaction force Fp acting on crankpin bearing portion 61 due to input loads Fu and Fc transferred via connecting-pin bearing portions 65 and 66, tends to concentrate on both axial ends of crankpin bearing portion 61 (see FIG. 18A). As a result, a localized load or stress concentration occurs at both axial ends of crankpin bearing portion 61, thus causing undesirable local deformations. In other words, there is an increased tendency of metal-to-metal contact between the axial ends of crankpin bearing portion 61 and the outer peripheral wall surface of the crankpin (the bearing journal portion). This deteriorates a sliding motion or sliding state of the crankpin. In contrast, in the lower link structure of the second embodiment, input loads Fu and Fc are applied to connecting-pin bearing members 22 and 23 via first and second connecting pins 12 and 14. The input loads are further transmitted via bearing member mounting bolts 24 and 25 to central connecting portion 30 of crankpin bearing member 21. Thereafter, the input load acts on crankpin bearing surface 31. As a consequence, the load acts mainly on the axial central portion of crankpin bearing surface 31 (see FIG. 18B). In other words, the input load does not act directly on both axial ends of the cylindrical crankpin bearing portion 32 (that is, both axial ends of the cylindrical crankpin bearing surface 31), extending from central connecting portion 30 in the opposite axial directions. Thus, as indicated by the one-dotted line in FIG. 18B, it is possible to effectively suppress or reduce undesirable localized load concentration or localized load concentration (that is, undesirable localized deformation) at the axial ends of crankpin bearing surface 31. In FIG. 18B, reference sign 29 denotes a film of lubricating oil. Load Fp acting on the axial central portion of crankpin bearing surface 31 can be effectively supported by way of the pressure of the lubricating oil film in the crankpin bearing portion, which pressure is relatively high at the axial central portion of crankpin bearing portion 32.

In the lower link structure of the second comparative example that first and second divided sections 63 and 64, formed with the mating surface 62, are formed integral with the respective connecting-pin bearing portions 65 and 66, and additionally the axial central portion of first divided section 63 and the axial central portion of second divided section 64 are integrally connected to each other by means of a sole connecting bolt 67. This structure leads to an increase in the bending stress that acts to open the mating surface 62 of divided sections 63 and 64. In order to prevent the mating surface from opening owing to the increased bending stress, the flexural rigidity must be taken into account. By taking into account the flexural rigidity as well as the mechanical rigidity suitable to reaction force Fp, necessarily, the total rigidity must be designed or set at a higher level. In this case, it is impossible to balance two contradictory requirements, that is, high rigidity and light weight. In contrast, in the lower link structure of the second embodiment that divided sections 36 and 37, formed with the mating surface 35, are formed as separate parts that are separated from connecting-pin bearing members 22 and 23 each formed integral with connecting-pin bearing portions 41 and 42. Thus, the load is transferred from connecting-pin bearing portions 41 and 42 via the bolt-connected portions (installation portions of bearing member mounting bolts 24 and 25) to mating surface 35. The magnitude of the bending stress that acts to open the mating surface 35 of divided sections 36 and 37, in other words, the deformation of divided-section connecting bolt 38 owing to the input load acting on the mating surface in the axial direction of divided-section connecting bolt 38 is very small. This reduces a required rigidity and strength of divided-section connecting bolt 38 and a portion around the divided-section connecting bolt, and thus enabling downsizing and lightening of the lower link.

In the lower link structure of the second embodiment, one of connecting-pin bearing members 22 and 23 has almost the same disk-like shape as the other. This contributes to easy machining and manufacturing, thereby reducing manufacturing costs. Each of connecting-pin bearing members 22 and 23 can be made of steel material and produced or formed by way of forging. In this case, it is possible to balance high mechanical strength and light weight. In designing crankpin bearing member 21, rather than taking into account the mechanical strength of a material itself, it is more important to take into account the structural rigidity of the crankpin bearing surface. Although a sintered alloy material or a cast iron material is inferior to a steel material in mechanical strength, the sintered alloy material or cast iron material is superior to the steel material in structural rigidity. It is desirable to use the sintered alloy material or cast iron material as a crankpin bearing member. More preferably, the crankpin bearing member 21 is formed of or made of the same alloy material (for example, a sintered alloy material) as crankpin bearing surface 31. The use of the sintered alloy material or cast iron material enhances the design flexibility and the degree of freedom of the shape, thus ensuring a more compact installation and light weight.

In addition to the above, in the second embodiment, the lower link is constructed such that the two connecting-pin bearing members 22 and 23 are securely connected or tightened to each other in the axial direction of crankpin 4 by means of bearing member mounting bolts 24 and 25, sandwiching crankpin bearing member 21 between them. Connecting-pin bearing portions 41 and 42, both formed integral with connecting-pin bearing members 22 and 23, can be fitted onto both sides of the respective connecting pins 12 and 14 after (at the later stage of assembly). Therefore, it is possible to integrally form first connecting pin 12 with upper link 11 and to integrally form second connecting pin 14 with control link 15. As compared to a case that connecting pins are press-fitted to the respective links at the last stage of assembly, in case of the lower link structure comprised of the upper link formed integral with the connecting pin and the control link formed integral with the connecting pin, it is possible to eliminate an increased stress, which may occur due to press-fitting. This ensures the enhanced assembling work and leads to light weight.

As a way to manufacture two divided sections 36 and 37 formed with a mating surface, first, crankpin bearing member 21 may be formed as a single member. Thereafter, the single member may be divided into two divided sections 36 and 37 at a certain surface (i.e., a mating surface 35). In case of such a manufacturing way, it is possible to easily produce divided sections 36 and 37 with a comparatively high accuracy, without using positioning pins.

As set forth above, according to the lower link structure of the second embodiment, it is possible to reduce the required rigidity and required strength for crankpin bearing surface 31 in comparison with the second comparative example. The lower link structure of the second embodiment increases the degree of freedom in selection of materials used as crankpin bearing member 21. Therefore, a portion of crankpin bearing member 21 except crankpin bearing surface 31 can be formed by the same alloy material for bearing as the crankpin bearing surface. Thus, it is unnecessary to use a bearing metal constructing the crankpin bearing surface as an additional part. This simplifies the structure of crankpin bearing member 21 and contributes to reduced manufacturing costs.

In the second embodiment, to form lower link 13, a plurality of members, namely first connecting-pin bearing member 22, divided sections 36 and 37 of crankpin bearing member 21, and second connecting-pin bearing member 23, are integrally connected to each other by means of bolts. Thus, it is possible to easily enhance the accuracy of each bearing surface and to enhance the installation accuracy of the lower link on the engine crankpin via three processes, that is, a first process that the bearing surface is finally machined in a state that all of the members 21, 22, and 23 are temporarily assembled to each other by bolts, a second process that these members 21, 22, and 23 are disassembled again by removing the bolts, and a third process that the members 21, 22, and 23 are finally really assembled or installed on crankpin 4. The same bolts used during temporarily assembling can be used as bolts for real installation of the members (21, 22, 23) on the engine crankpin. Also, the number of the bolt-connected portions is two or more. As a result of this, it is possible to reduce or suppress the required strength and rigidity of each of the bolt-connected portions. Additionally, according to the lower link structure of the second embodiment, bearing member mounting bolts 24 and 25 that integrally connect crankpin bearing member 21 and connecting-pin bearing members 22 and 23, are arranged in the axial direction of crankpin 4. Thus, the magnitude of tensile load acting on each of bearing member mounting bolts 24 and 25 is very small. It is possible to reduce the diameter of each bolt, thus ensuring more reduced lower-link assembly weight. The magnitudes of loads acting on the respective bearing member mounting bolts 24 and 25 are different for each bolt-connected portion. Thus, it is possible to more effectively reduce the total weight of the lower link, while maintaining the required strength, by properly selecting the bolt diameter suitable to a required strength for each bolt-connected portion. In the shown embodiment, input load Fu from the upper link on which the combustion load acts, tends to be greater than input load Fc from the control link. For this reason, the diameter of bearing member mounting bolt 24 close to first connecting-pin bearing portion 41 and its bolt holes 33 and 45 are dimensioned to be greater than the diameter of bearing member mounting bolt 25 close to second connecting-pin bearing portion 42 and its bolt holes 34 and 46, respectively (see FIG. 13).

As seen in FIG. 17A, crankpin bearing portion 32, and two connecting-pin bearing portions 41 and 42 are triangularly arranged with each other as viewed from the axial direction of crankpin 4. Therefore, first and second connecting pins 12 and 14 and their pin-boss portions, that is, the effective center of gravity of the lower link including first and second connecting pins 12 and 14 and pin-boss portions of upper link 11 and control link 15 tend to be offset from the position of the lower-link center-of-gravity not including pin-boss portions of upper link 11 and control link 15 with respect to the axis of the cylindrical crankpin bearing surface 31 toward the connecting-pin bearing portions. That is, the effective lower-link center-of-gravity tends to be shifted from the lower-link center-of-gravity not including pin-boss portions in the upward direction (viewing FIG. 17A). The motion of lower link 13 includes rotation on its own axis. Therefore, an inertia force having higher-order frequency components than engine revolutions takes place, owing to the offset of the effective lower-link center-of-gravity. A frequency component of first-order oscillations caused by engine revolutions can be easily attenuated or canceled by increasing the number of engine cylinders. However, it is difficult to attenuate or cancel higher-order oscillation-frequency components. Due to higher-order frequency components, engine shake may occur. According to the lower link structure of the second embodiment, the bolt-connected portions for bearing member mounting bolts 24 and 25 are arranged on the opposite side to connecting-pin bearing portions 41 and 42 with respect to the axis of crankpin bearing surface 31. As a matter of course, as viewed from the elevation view of FIG. 17A, the weight of the lower portion of lower link 13 tends to be greater than that of the upper portion having connecting-pin bearing portions 41 and 42. As a result, it is possible to effectively attenuate or reduce engine vibration by approaching the effective center of gravity of the lower link closer to the axis of crankpin bearing surface 31. The position of the effective center of gravity of the lower link including first and second connecting pins 12 and 14 and pin-boss portions of upper link 11 and control link 15 is designed or set to be closer to the axis of crankpin bearing surface 13, in comparison with the position of the lower-link center-of-gravity not including pin-boss portions. In the lower link structure of the second embodiment, the center of gravity of the lower link not including the pin-boss portions is designed to be considerably downwardly offset from connecting-pin bearing portions 41 and 42, such that the effective center of gravity of the lower link including the pin-boss portions is designed to be substantially identical to the axis of crankpin bearing surface 31.

Figure 19:
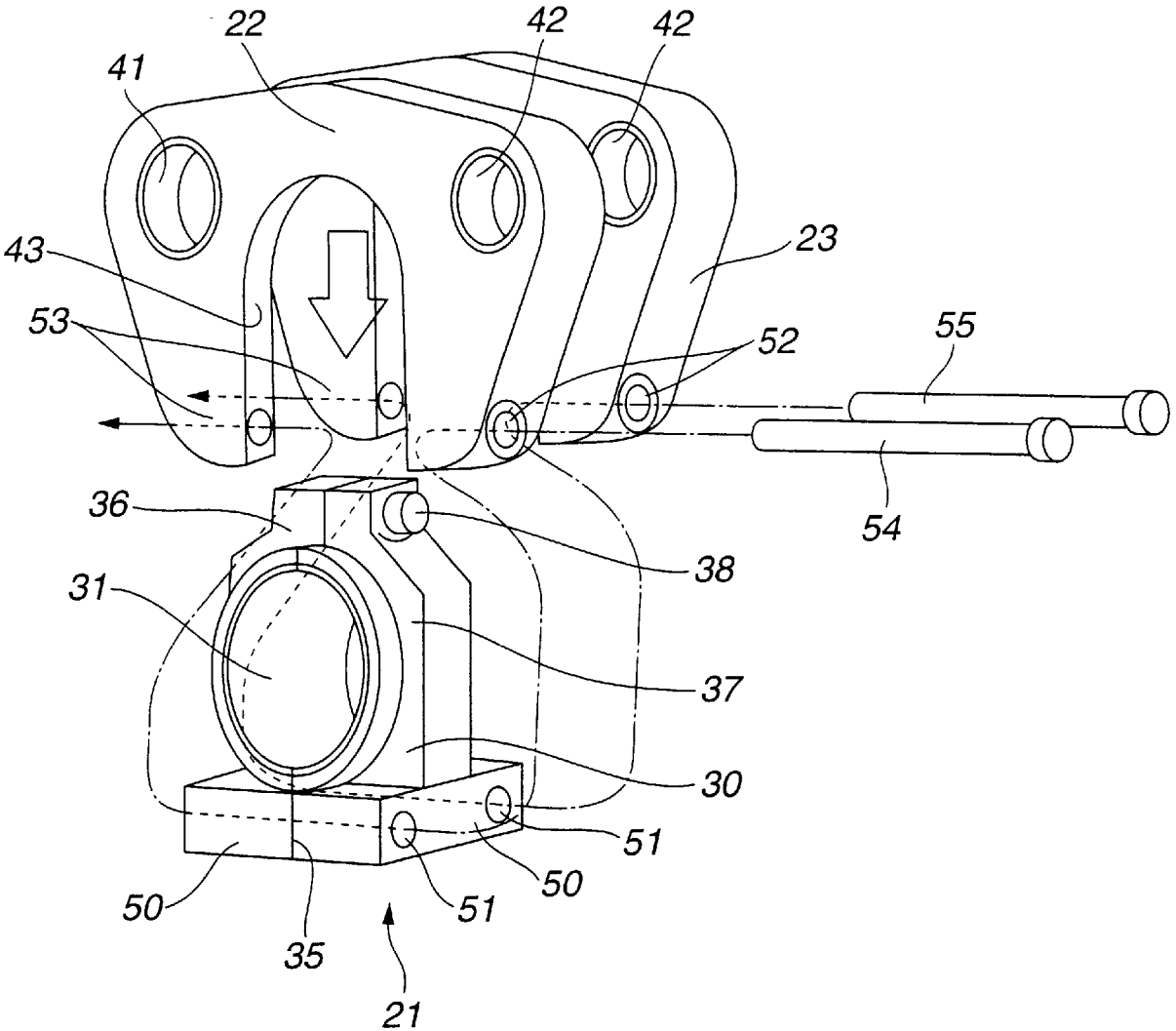
FIG. 19 is a disassembled perspective view of the lower link of a third embodiment.
Figure 20:
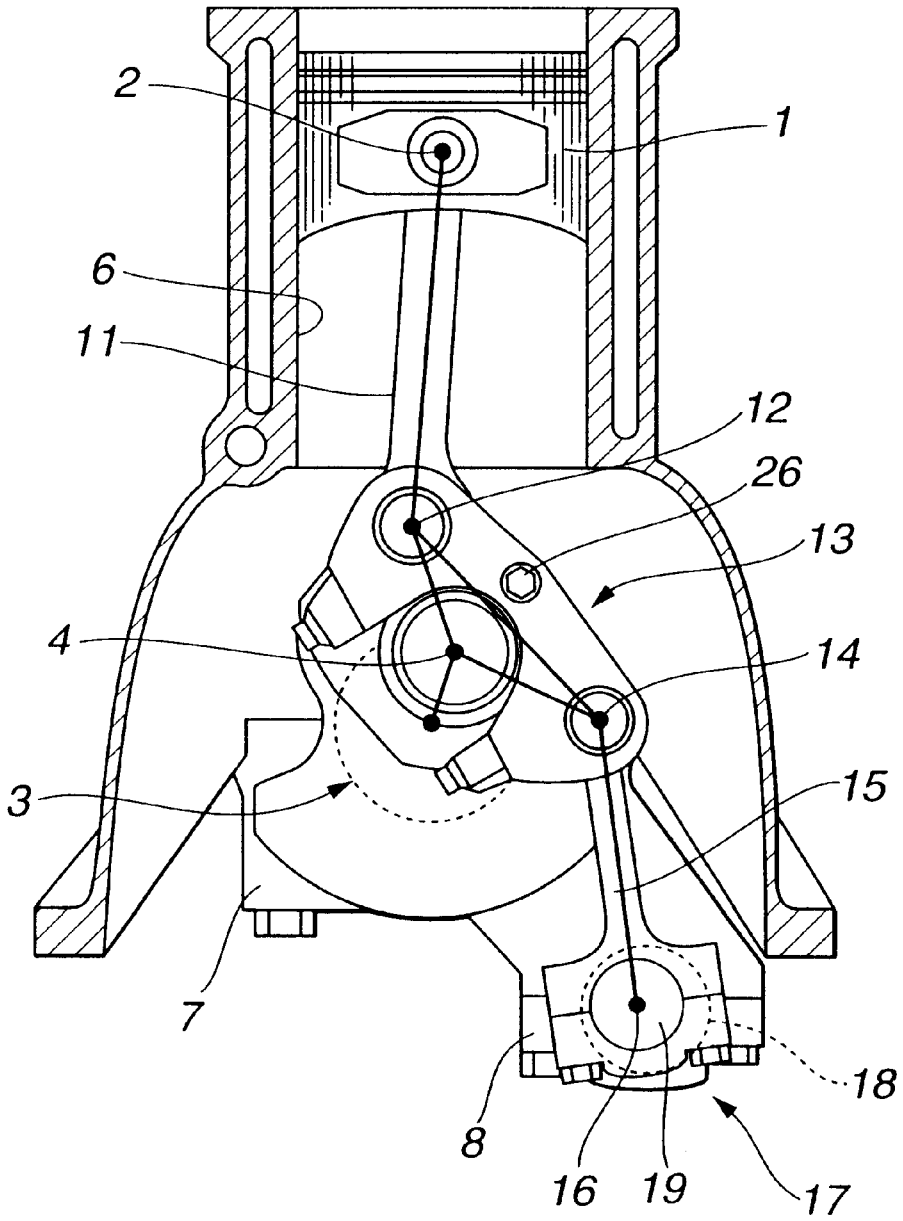
FIG. 20 is a cross-sectional view showing a fourth embodiment of the variable compression ratio mechanism of the invention.

Referring to FIG. 19, there is shown the detailed lower link structure of the third embodiment. Briefly speaking, the lower link of third embodiment is different from that of the second embodiment, in that a tightening direction of a pair of bearing member mounting bolts 54 and 55 used for the third embodiment is the direction normal to the axial direction of crankpin 4. As seen in FIG. 19, in the lower link structure of the third embodiment, bearing member mounting bolts 54 and 55 that integrally connect crankpin bearing member 21, and first and second connecting-pin bearing members 22 and 23, also serve as divided-section connecting bolts that integrally connect divided sections 36 and 37 of crankpin bearing member 21. A pair of partly axially extending bolt-boss portions 50 for bolts 54 and 55 are respectively formed at the lower portion of divided section 36 and the lower portion of divided section 37, both constructing the crankpin bearing member 21. In the assembled state, these bolt-boss portions (50, 50) are fitted into substantially U-shaped primary cut-out portions 43 of connecting-pin bearing members 22 and 23. Each of bolt-boss portions 50 is formed with a pair of bolt holes 51 for bearing member mounting bolts 54 and 55, such that bolt holes 51 extend in the direction normal to the axial direction of crankpin 4 from one side to the other side of mating surface 35. Each of divided sections 36 and 37 is also formed at its upper portion with a bolt hole for divided-section connecting bolt 38. Thus, in the lower link structure of the third embodiment of FIG. 19, by means of three bolts, namely divided-section mounting bolt 38, and two bearing member mounting bolts 54 and 55, divided sections 36 and 37 are securely connected or tightened. On the other hand, each of connecting-pin bearing members 22 and 23 is formed with a pair of bolt holes 52 for bearing member mounting bolts 54 and 55, such that bolt holes 52 extend in the direction normal to the axial direction of crankpin 4 and that axes of bolt holes 52 are identical to axes of bolt holes 51 in the assembled state. As can be appreciated from FIG. 19, the right-hand bolt hole section of each bolt hole 52 is formed as a counter-bored bolt hole section, whereas the left-hand bolt hole section of each bolt hole 52 is formed as a female screw-threaded bolt hole section 53 into which one of bearing member mounting bolts 54 and 55 is screwed. Bolt holes (52, 52) are arranged on the opposite side to connecting-pin bearing portions 41 and 42 with respect to the axis of crankpin bearing surface 31. According to the lower link structure of the third embodiment, it is possible to provide the same operation and effects as the second embodiment. Additionally, in the third embodiment bearing member mounting bolts 54 and 55 that integrally connect crankpin bearing member 21, and connecting-pin bearing members 22 and 23 to each other, also serve as divided-section connecting bolts that integrally connect the lower end portions of divided sections 36 and 37 to each other. It is possible to reduce the number of parts, thus ensuring light weight and reduced manufacturing costs.

Figure 21:
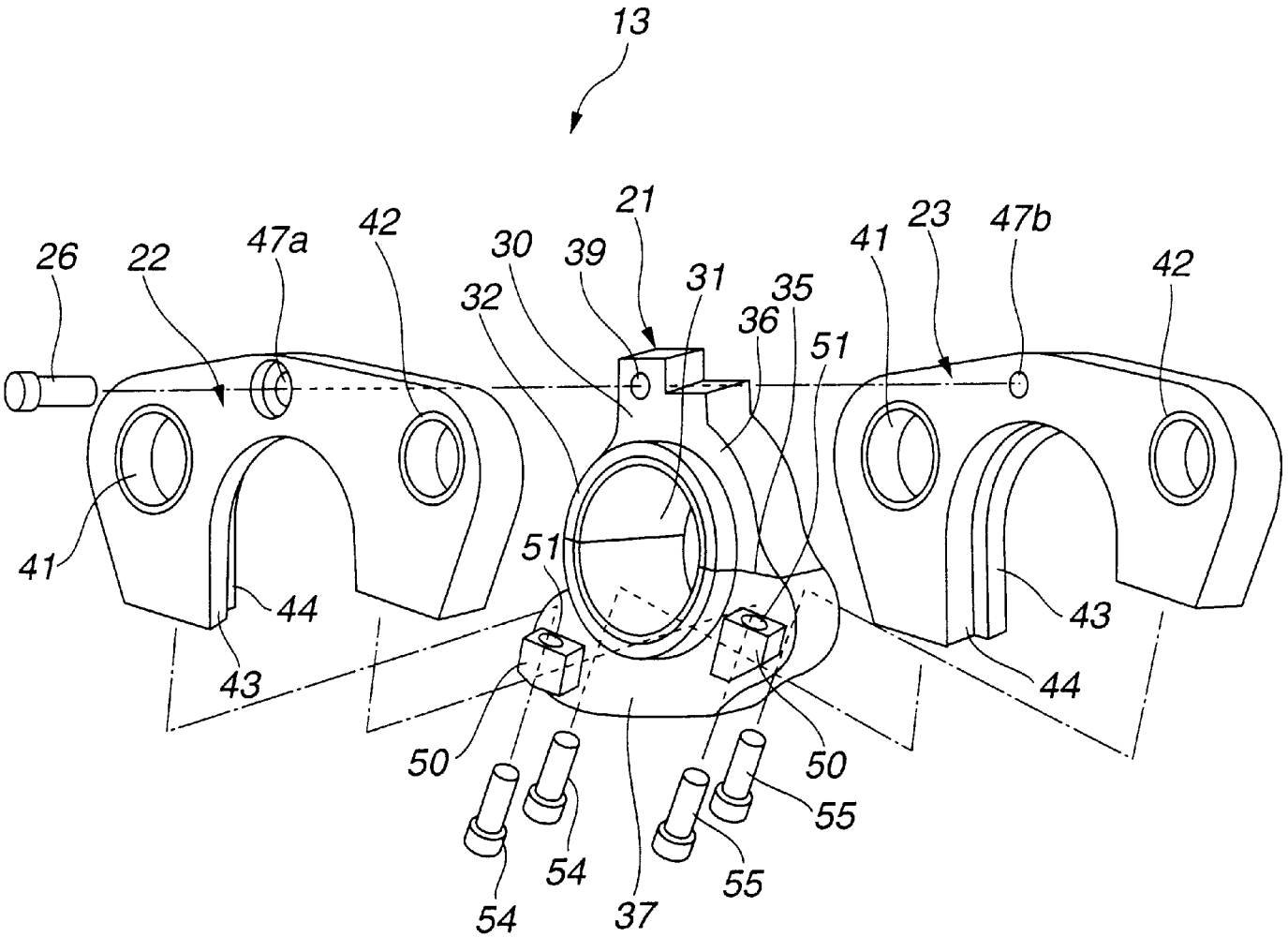
FIG. 21 is a disassembled perspective view showing a lower link of the fourth embodiment.
Figure 22A:
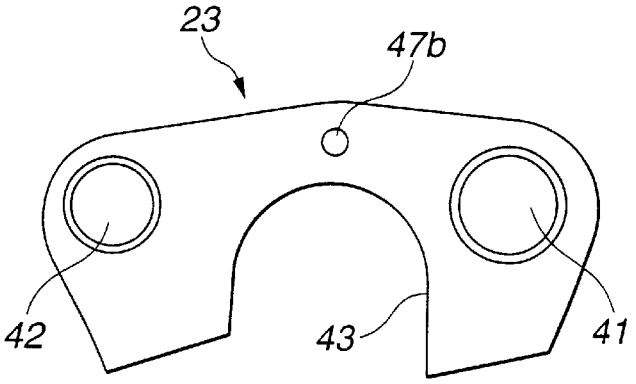
FIG. 22A is a front elevation view showing a pair of connecting-pin bearing members of the fourth embodiment.
Figure 22A:
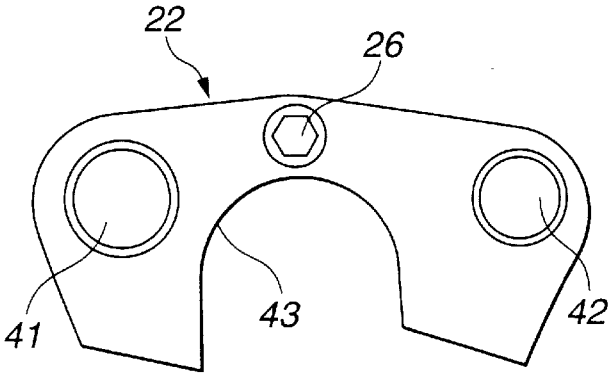
Figure 22B:
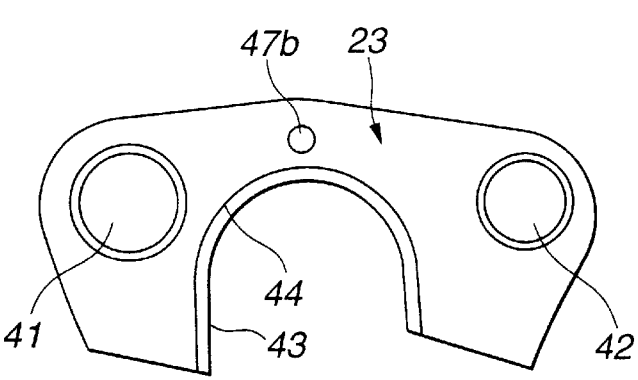
FIG. 22B is a back view showing the pair of connecting-pin bearing members of the fourth embodiment.
Figure 22B:
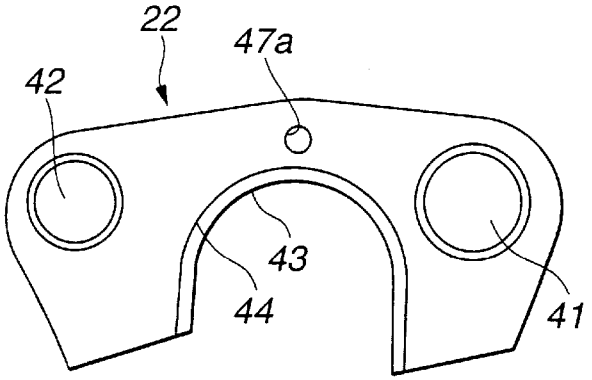
Figure 22C:
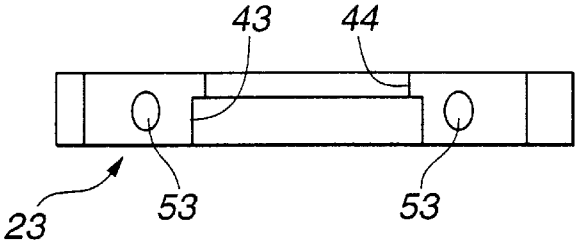
FIG. 22C is a bottom view showing the pair of connecting-pin bearing members of the fourth embodiment.
Figure 22C:
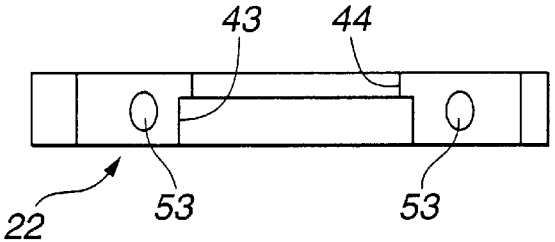

Referring now to FIGS. 20, 21, 22A–22C, 23A–23D, and 24A–24B, there is shown the detailed lower link structure of the fourth embodiment. By means of a bearing member mounting bolt 26, first connecting-pin bearing member 22, crankpin bearing member 21, and second connecting-pin bearing member 23 are securely connected or tightened together, so that first divided section 36 of crankpin bearing member 21 is sandwiched between first and second connecting-pin bearing members 22 and 23. In a state that first connecting-pin bearing member 22, first divided section 36, and second connecting-pin bearing member 23 are temporarily assembled to each other by means of bearing member mounting bolt 26, a part (the upper half-round section) of crankpin bearing surface 31 formed in first divided section 36, and substantially U-shaped primary and secondary cut-out portions 43 and 44 of each connecting-pin bearing member (22, 23) are laid out to open in the same direction (in the downward direction in FIG. 21). There is the angular difference of 90 degrees between the direction that mating surface 35 in the lower link structure of the fourth embodiment extends and the direction that mating surface 35 in the lower link structure of the second and third embodiments extends. The previously-noted bearing member mounting bolt 26 is located in a substantially middle position between first and second connecting-pin bearing portions 41 and 42. As best seen in FIG. 21, as a bolt hole for bearing member mounting bolt 26, first connecting-pin bearing member 22 is formed with a counter-bored bolt hole 47*a*, while second connecting-pin bearing member 23 is formed with a female screw-threaded bolt hole 47*b*. First divided section 36 of crankpin bearing member 21 is also formed with a through-opening 39 that is aligned with each bolt hole (47*a*, 47*b*) when assembling. First connecting-pin bearing member 22, a second divided section 37 of crankpin bearing member 21, and second connecting-pin bearing member 23 are integrally connected to each other by means of four bolts, namely a first group of bearing member mounting bolts (54, 54) and a second group of bearing member mounting bolts (55, 55). These mounting bolts (54, 54, 55, 55) are arranged in the direction substantially perpendicular to mating surface 35, so that a strong compressive force acts on the mating surface of first and second divided sections 36 and 37. That is, four bearing member mountingbolts (54, 54, 55, 55) also serve as divided-section connecting bolts that integrally connect first divided section 36 to second divided section 37. Partly axially extending bolt-boss portions (50, 50, 50, 50) for bolts (54, 54, 55, 55) are formed at the central connecting portion 30 of second divided section 37 (the lower divided section in FIG. 21). Each bolt-boss portion 50 is formed with a bolt hole (a through-opening) 51. Each of connecting-pin bearing members 22 and 23 is also formed with a pair of female screw-threaded bolt holes into which mounting bolts 54 and 55 are screwed (see FIG. 22C). As discussed above, in the lower link structure of the fourth embodiment, a part (the upper half-round section) of crankpin bearing surface 31 formed in first divided section 36, and substantially U-shaped primary and secondary cut-out portions 43 and 44 are laid out to open in the same direction (in the downward direction in FIG. 21). Thus, at the early stage of assembly, it is possible to connect first connecting-pin bearing member 22, first divided section 36 of the crankpin bearing member, and second connecting-pin bearing member 23 integral with each other as an intermediate assembly by means of bearing member mounting bolt 26. Therefore, when finally or really assembling or installing the lower link 13 on crankpin 4, the real installation is easily efficiently achieved by integrally connecting the intermediate assembly with second divided section 37, sandwiching the crankpin between them, by tightening bolts (54, 54, 55, 55). This ensures easy assembling. Tightening the dual-purpose bolts (54, 54, 55, 55) having two functions, namely the bearing member mounting use and the divided section connecting use, enables second divided section 37 to be fixedly connected to connecting-pin bearing members 22 and 23, and simultaneously permits a strong compressive force to act on the mating surface 35 of second divided section 37 and first divided section 36 fixedly connected to connecting-pin bearing members 22 and 23.

Figure 23B:
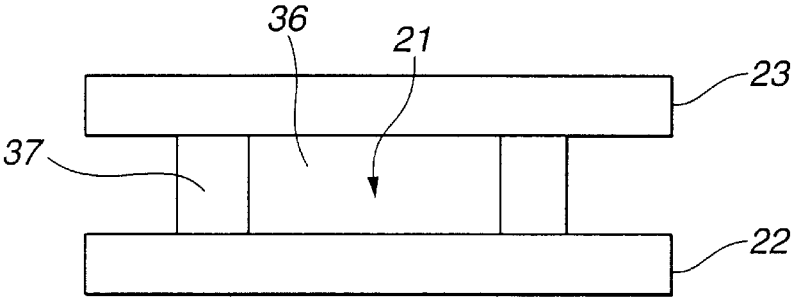
FIG. 23B is a top view showing the lower link of the fourth embodiment.
Figure 23A:
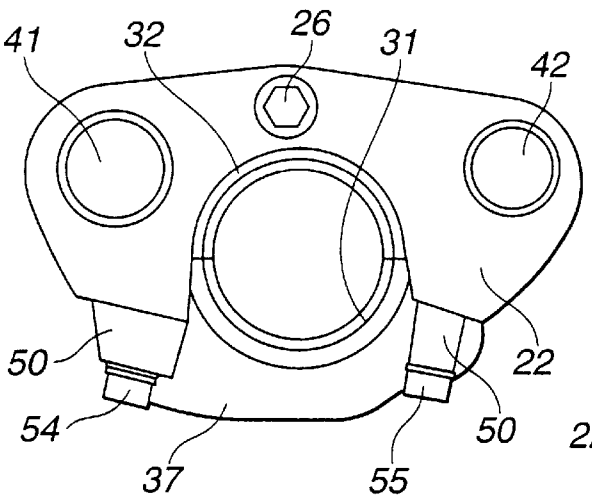
FIG. 23A is a front elevation view showing the lower link of the fourth embodiment.
Figure 23D:
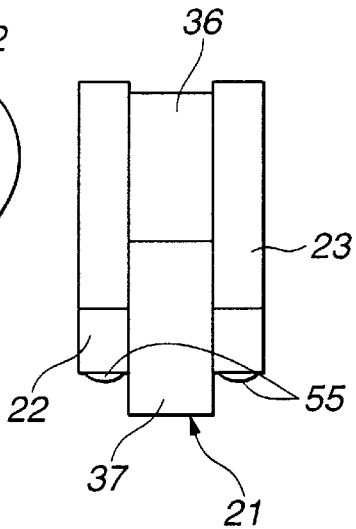
FIG. 23D is a right-hand side view showing the lower link of the fourth embodiment.
Figure 23C:
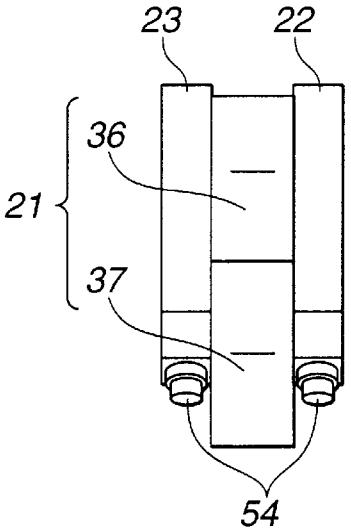
FIG. 23C is a left-hand side view showing the lower link of the fourth embodiment.
Figure 24A:
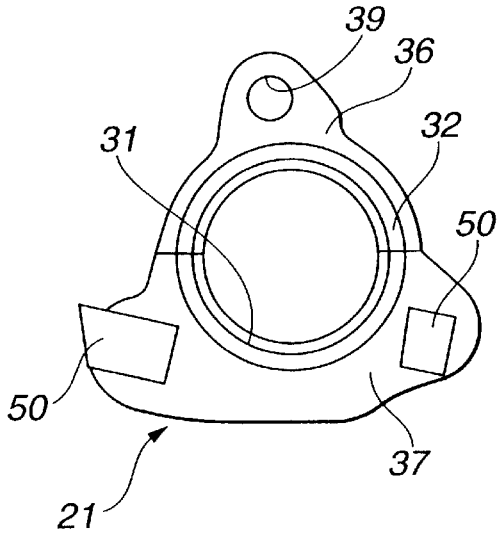
FIG. 24A is a front elevation view showing only a crankpin bearing member of the fourth embodiment.
Figure 24B:
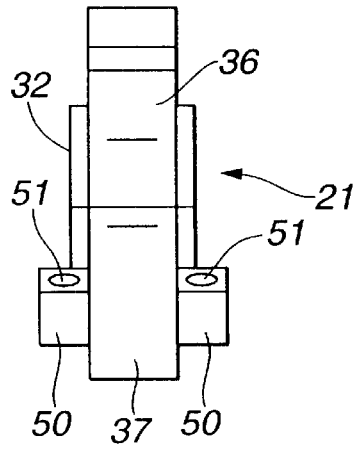
FIG. 24B is a right-hand side view of the crankpin bearing member of the fourth embodiment.
Figure 25:
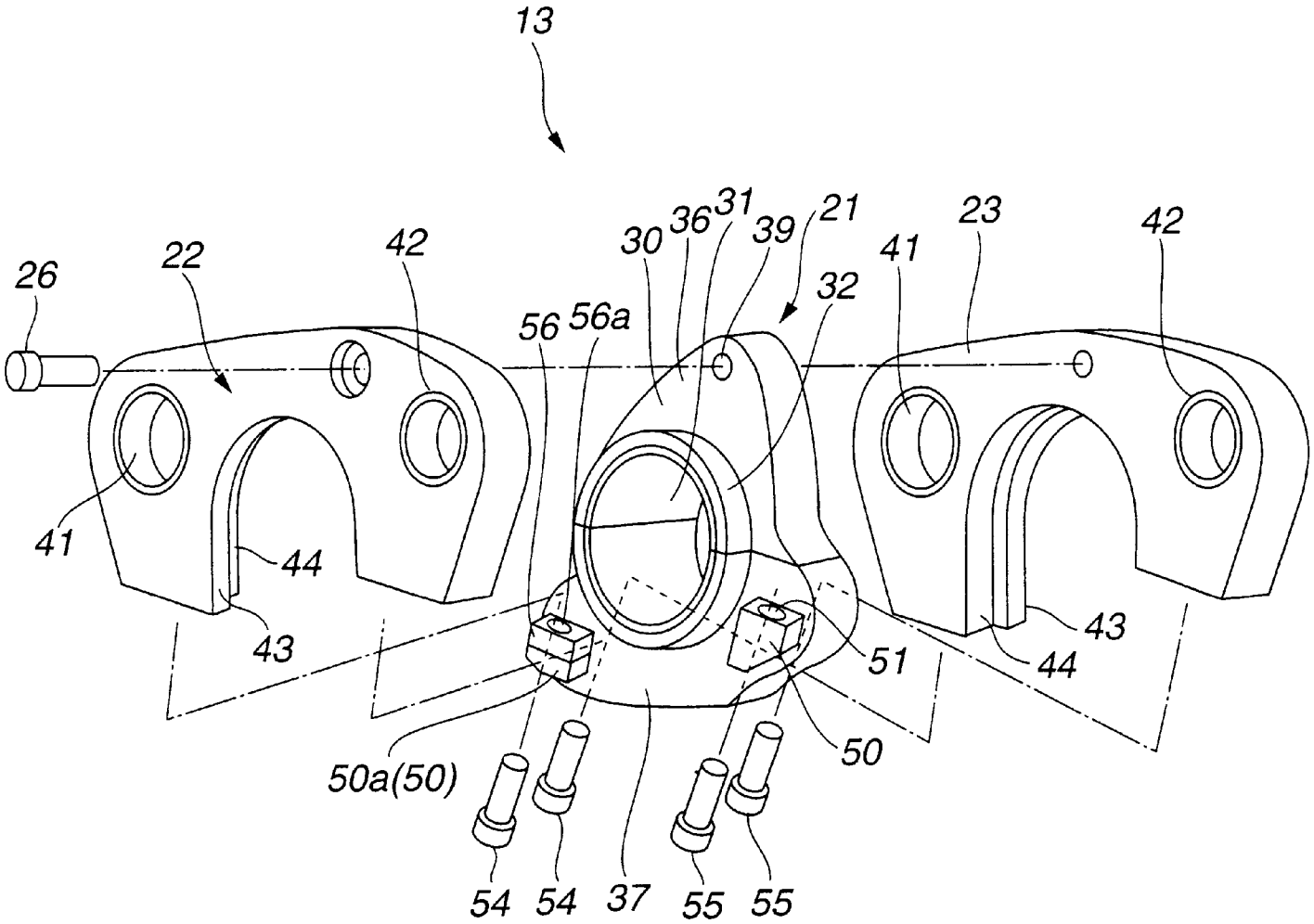
FIG. 25 is a disassembled perspective view of a lower link of a fifth embodiment.
Figure 26B:
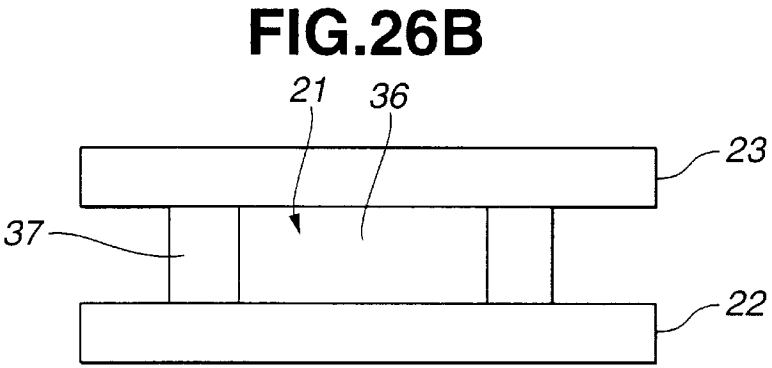
FIG. 26B is a top view showing the lower link of the fifth embodiment.
Figure 26A:
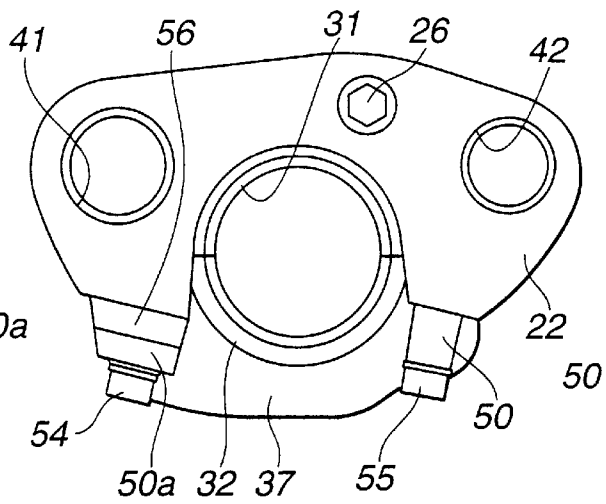
FIG. 26A is a front elevation view showing the lower link of the fifth embodiment.
Figure 26D:
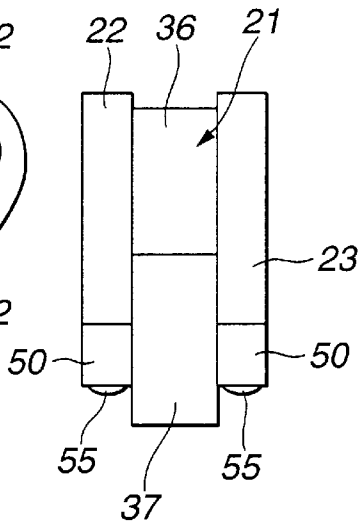
FIG. 26D is a right-hand side view showing the lower link of the fifth embodiment.
Figure 26C:
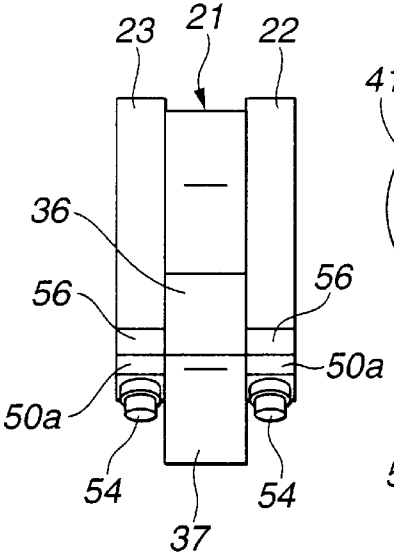
FIG. 26C is a left-hand side view showing the lower link of the fifth embodiment.
Figure 27C:
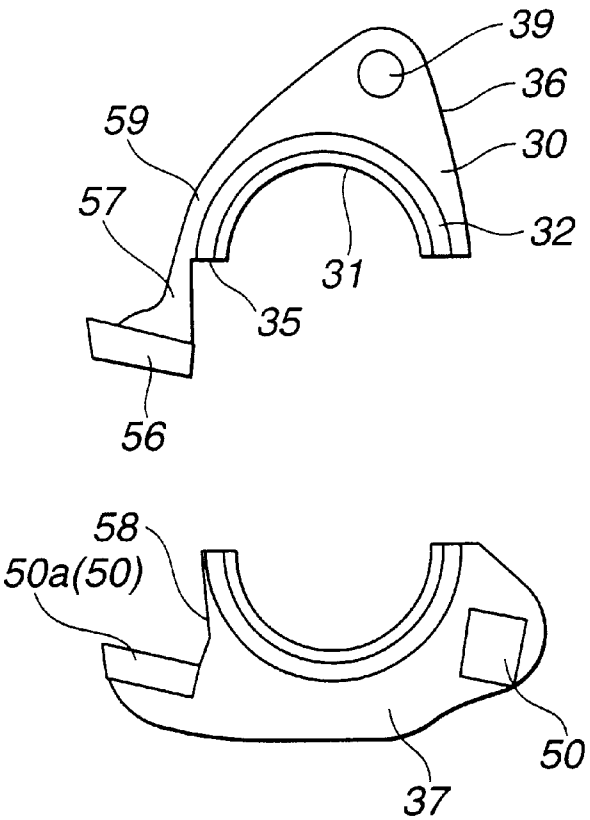
FIG. 27C is a disassembled front elevation view of the crankpin bearing member of the fifth embodiment.
Figure 27B:
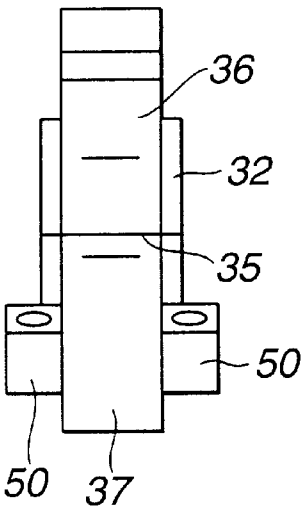
FIG. 27B is a right-hand side view of the crankpin bearing member of the fifth embodiment.
Figure 27A:
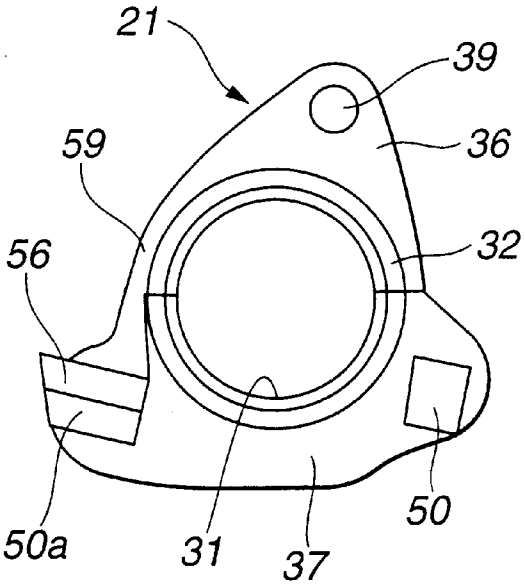
FIG. 27A is a front elevation view showing only a crankpin bearing member of the fifth embodiment.

As appreciated from FIGS. 23A (the axial view), 23C (the left-hand side view), and 23D (the right-hand side view), each connecting-pin bearing member (22, 23) is equipped with two dual-purpose bolts 54 and 55, which are laid out on both sides of crankpin bearing surface 31. As viewed from the axial direction of crankpin 4 (see FIG. 23A), the two dual-purpose bolts 54 and 55, and bearing member mounting bolt 26 are triangularly arranged with each other in a manner so as to surround crankpin bearing portion 32. Thus, it is possible to effectively enhance the rigidity of the circumference of crankpin bearing portion 32.

As viewed from the axial direction of crankpin 4, first connecting-pin bearing portion 41 is laid out substantially midway between a first dual-purpose bolt 54 (closer to first connecting-pin bearing portion 41) of two dual-purpose bolts (54, 55) and bearing member mounting bolt 26. Three points, namely the axis of first connecting-pin bearing portion 41, the head portion of first dual-purpose bolt 54, and the head portion of bearing member mounting bolt 26 are triangularly arranged with each other. Therefore, the input load from first connecting pin 12 can be effectively supported or received mainly by means of bearing member mounting bolt 26 and the first dual-purpose bolt 54. Thus, there is no risk of excessive moment application to the opposite dual-purpose bolt 55. In the same manner, second connecting-pin bearing portion 42 is laid out substantially midway between the second dual-purpose bolt 55 (closer to second connecting-pin bearing portion 42) and bearing member mounting bolt 26. Three points, namely the axis of second connecting-pin bearing portion 42, the head portion of second dual-purpose bolt 55, and the head portion of bearing member mounting bolt 26 are triangularly arranged with each other. Therefore, the input load from second connecting pin 14 can be effectively supported or received mainly by means of bearing member mounting bolt 26 and the second dual-purpose bolt 55. Thus, there is no risk of excessive moment application to the opposite dual-purpose bolt 54.

Referring now to FIGS. 25, 26A–26D, and 27A–27C, there is shown the detailed lower link structure of the fifth embodiment. Second divided section 37 (the lower divided section) is formed with four bolt-boss portions (50, 50, 50, 50), which are fixedly connected to connecting-pin bearing members 22 and 23 by means of dual-purpose bolts (54, 54, 55, 55). First divided section 36 (the upper divided section) is formed with a pair of extension boss portions (56, 56). Each extension boss portion 56 has a bolt hole 56*a* into which the first dual-purpose bolt 54 closer to first connecting-pin bearing portion 41 is inserted. Extension boss portions 56 are securely connected or tightened together with the respective boss portions 50*a* (bolt-boss portions 50) of second divided section 37 to connecting-pin bearing members 22 and 23 by means of the first dual-purpose bolts (54, 54). As clearly seen in FIG. 27C, central connecting portion 30 of first divided section 36 is formed integral with an extension portion 57 circumferentially extending across the mating surface 35. The previously-noted extension boss portions (56, 56) are formed on the tip of extension portion 57. Second divided section 37 has a cut-out portion 58 to which extension portion 57 is fitted.

As set forth above, it is possible to enhance bonding or connecting force between first and second divided sections 36 and 37 at the mating surface by integrally connecting extension boss portions (56, 56) of first divided section 36 to connecting-pin bearing members 22 and 23 together with boss portions (50*a*, 50*a*) of second divided section 37 by means of dual-purpose bolts (54, 54). Owing to such a high connecting force, it is possible to prevent the mating surface of divided sections 36 and 37 from undesiredly opening.

In the lower link structure of the fifth embodiment, mainly in order to avoid undesired interference or contact between bearing member mounting bolt 26 and upper link 11, bearing member mounting bolt 26 is spaced apart from first connecting-pin bearing portion 41 and laid out closer to second connecting-pin bearing portion 42. That is, the center distance between bearing member mounting bolt 26 and first connecting-pin bearing portion 41 is relatively greater than the center distance between bearing member mounting bolt 26 and second connecting-pin bearing portion 42. Owing to the relative-position relationship among bearing member mounting bolt 26 and first and second connecting-pin bearing portion 41 and 42, it is somewhat difficult to adequately ensure the rigidity of a portion 59 (the left-hand side portion) of first divided section 36, closer to first connecting-pin bearing portion 41. In other words, the portion 59 of first divided section 36 tends to deform. Thus, considering the portion 59 having a somewhat weaker rigidity, the previously-noted extension boss portions (56, 56) are formed on the tip of extension portion 57, so as to optimize the total rigidity in the assembled state and to minimize the deformation of the lower link installed on the crankpin.

In the fifth embodiment shown in FIGS. 25, 26A–26D, and 27A–27C, the extension boss portions (56, 56) are arranged on one side (the left-hand side in FIGS. 27A and 27C) of crankpin bearing portion 32. As necessary, extension boss portions are arranged on both sides of crankpin bearing portion 32.

The entire contents of Japanese Patent Application No. P2002-057133 (filed Mar. 4, 2002) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable compression ratio mechanism for a reciprocating internal combustion engine employing a reciprocating piston movable through a stroke in the engine and having a piston pin, and a crankshaft changing reciprocating motion of the piston into rotating motion and having a crankpin, comprising:

an upper link connected at its one end to the piston pin;

a lower link connected to the other end of the upper link via a first connecting pin and rotatably installed on the crankpin;

a control link connected at its one end to the lower link via a second connecting pin, and pivotably connected at the other end to a body of the engine to permit oscillating motion of the control link on the body of the engine;

a control mechanism shifting a center of oscillating motion of the control link to vary a compression ratio of the engine; and the lower link comprising:

a crankpin bearing portion into which the crankpin is fitted;

a first connecting-pin bearing portion, which is parallel to the crankpin bearing portion and into which the first connecting pin is fitted;

a second connecting-pin bearing portion, which is parallel to the crankpin bearing portion and into which the second connecting pin is fitted;

a central connecting portion having an axial length shorter than each of an axial length of the crankpin bearing portion, an axial length of the first connecting-pin bearing portion, and an axial length of the second connecting-pin bearing portion; and the central connecting portion that connects an axial central portion of at least one of the first and second connecting-pin bearing portions to an axial central portion of the crankpin bearing portion.

2. The variable compression ratio mechanism as claimed in claim 1, wherein:

the first and second connecting-pin bearing portions are connected to the crankpin bearing portion via only the central connecting portion.

3. The variable compression ratio mechanism as claimed in claim 2, wherein:

the lower link comprises a first member that is integrally formed with at least a portion of a circumferentially-extending bearing section of the crankpin bearing portion and one of the first and second connecting-pin bearing portions.

4. The variable compression ratio mechanism as claimed in claim 2, wherein:

the lower link comprises a second member that is integrally formed with the other portion of the circumferentially-extending bearing section of the crankpin bearing portion and a third member that is integrally formed with the other connecting-pin bearing portion; and a center distance between the connecting-pin bearing portion integrally formed with the third member and the crankpin bearing portion is dimensioned to be shorter than a center distance between the connecting-pin bearing portion integrally formed with the first member and the crankpin bearing portion.

5. The variable compression ratio mechanism as claimed in claim 4, wherein:

a fixing device that fixedly connect the first, second, and third members to each other, so that two members selected from the first, second, and third members, sandwich therebetween at least a portion of a non-selected member of the first, second, and third members in a direction normal to an axial direction of the crankpin.

6. The variable compression ratio mechanism as claimed in claim 5, wherein:

the fixing device comprises a first bolt and a second bolt, both fastening and fixing the first, second, and third members to each other in the direction normal to the axial direction of the crankpin.

7. The variable compression ratio mechanism as claimed in claim 6, wherein:

the first bolt fastens the first member to the third member so that a portion of the second member is sandwiched between the first and third members.

8. The variable compression ratio mechanism as claimed in claim 7, wherein:

the second bolt fastens the first member to the second member so that a portion of the third member is sandwiched between the first and second members.

9. The variable compression ratio mechanism as claimed in claim 6, wherein:

the fastening device comprises a third bolt that fastens the first member to the third member.

10. The variable compression ratio mechanism as claimed in claim 6, wherein:

a bolt hole for the first bolt, and a bolt hole for the second bolt is formed to open in the same direction.

11. The variable compression ratio mechanism as claimed in claim 2, wherein:

the lower link comprises a crankpin bearing member that is integrally formed with the crankpin bearing portion, and a connecting-pin bearing member that is integrally formed with the first and second connecting-pin bearing portions;

the crankpin bearing member and the connecting-pin bearing member are formed as separate parts that are separable from each other; and the crankpin bearing member and the connecting-pin bearing member are integrally connected to each other at a position that is spaced apart from a portion that the first connecting-pin bearing portion exists and a portion that the second connecting-pin bearing portion exists.

12. The variable compression ratio mechanism as claimed in claim 2, wherein:

the lower link comprises a crankpin bearing member that is integrally formed with the crankpin bearing portion, and a connecting-pin bearing member that is integrally formed with the first and second connecting-pin bearing portions;

the central connecting portion is formed integral with the crankpin bearing member;

the connecting-pin bearing member is integrally connected to the central connecting portion, while being kept in non-contact with the crankpin bearing portion.

13. The variable compression ratio mechanism as claimed in claim 11, wherein:

the connecting-pin bearing member comprises a pair of plate-shaped members that are integrally connected on both sides of the crankpin bearing member so as to sandwich the crankpin bearing member between the plate-shaped members in an axial direction of the crankpin.

14. The variable compression ratio mechanism as claimed in claim 13, wherein:

each of the plate-shaped members is integrally formed with the first connecting-pin bearing portion having a bearing surface onto which the first connecting pin is fitted and the second connecting-pin bearing portion having a bearing surface onto which the second connecting pin is fitted; and the first connecting-pin bearing portions of the plate-shaped members are axially aligned with each other and the second connecting-pin bearing portions of the plate-shaped members are axially aligned with each other, in an assembled state that the plate-shaped members are assembled to the crankpin bearing member.

15. The variable compression ratio mechanism as claimed in claim 11, wherein:

the crankpin bearing member is formed of the same alloy material as a bearing surface of the crankpin.

16. The variable compression ratio mechanism as claimed in claim 11, wherein:

an effective center of gravity of the lower link including the first and second connecting pins and pin-boss portions of the first and second connecting pins is set to be closer to an axis of the crankpin bearing portion than a center of gravity of the lower link except the first and second connecting pins and the pin-boss portions.

17. The variable compression ratio mechanism as claimed in claim 11, wherein:

the crankpin bearing member is divided into a pair of divided sections by a mating surface that passes an axis of the crankpin bearing portion.

18. The variable compression ratio mechanism as claimed in claim 17, wherein:

at least one of a plurality of bearing member mounting bolts that integrally connect the crankpin bearing member to the connecting-pin bearing member is a dual-purpose bolt also serving to integrally connect the divided sections with each other.

19. The variable compression ratio mechanism as claimed in claim 18, wherein:

the connecting-pin bearing member comprises a pair of plate-shaped members that are integrally connected on both sides of the crankpin bearing member so as to sandwich the crankpin bearing member between the plate-shaped members in an axial direction of the crankpin;

at least one of the divided sections is formed with a bolt-boss portion extending in the axial direction of the crankpin; and the bolt-boss portion and the plate-shaped member are integrally connected to each other by the dual-purpose bolt.

20. The variable compression ratio mechanism as claimed in claim 19, wherein:

each of the plate-shaped members is formed with a cut-out portion to avoid the crankpin from being brought into contact with each of the plate-shaped members;

at least one of the plurality of bearing member mounting bolts fixedly connects the plate-shaped members to a first divided section of the divided sections so that a part of the crankpin bearing portion formed in the first divided section and the cut-out portions of the plate-shaped members open in the same direction; and the bolt-boss portion is integrally formed with the second divided section.

* * * * *